US007188934B2

(12) United States Patent
Lean et al.

(10) Patent No.: US 7,188,934 B2
(45) **Date of Patent: *Mar. 13, 2007**

(54) ELECTROSTATIC GATING

(75) Inventors: Meng H. Lean, Santa Clara, CA (US); John J. Ricciardelli, Poughkeepsie, NY (US); Osman T. Polatkan, N. Haledon, NJ (US); Michael J. Savino, Tappan, NY (US); Armin R. Völkel, Mountain View, CA (US)

(73) Assignee: Xerox Corporation, Stamford, CT (US)

( * ) Notice: Subject to any disclaimer, the term of this patent is extended or adjusted under 35 U.S.C. 154(b) by 301 days.

This patent is subject to a terminal disclaimer.

(21) Appl. No.: 10/960,599

(22) Filed: Oct. 7, 2004

(65) Prior Publication Data

US 2006/0077231 A1 Apr. 13, 2006

(51) Int. Cl.
*B41J 2/06* (2006.01)

(52) U.S. Cl. ..... 347/55; 347/56

(58) Field of Classification Search ..... 347/20, 347/21, 40, 42, 44, 47, 54–56, 57
See application file for complete search history.

(56) References Cited

U.S. PATENT DOCUMENTS

| | | | | |
|---|---|---|---|---|
| 4,896,174 | A | 1/1990 | Stearns | 347/120 |
| 5,893,015 | A | 4/1999 | Mojarradi et al. | 399/291 |
| 6,116,718 | A | 9/2000 | Peeters et al. | 347/21 |
| 6,134,412 | A | 10/2000 | Thompson | 399/266 |
| 6,137,979 | A | 10/2000 | Gartstein et al. | 399/266 |
| 6,219,515 | B1 | 4/2001 | Lestrange | 399/289 |
| 6,246,855 | B1 | 6/2001 | Gartstein et al. | 399/281 |
| 6,272,296 | B1 | 8/2001 | Gartstein | 399/55 |
| 6,290,342 | B1 | 9/2001 | Vo et al. | 347/55 |
| 6,293,659 | B1 | 9/2001 | Floyd et al. | 347/85 |
| 6,328,409 | B1 | 12/2001 | Peeters et al. | 347/21 |
| 6,340,216 | B1 * | 1/2002 | Peeters et al. | 347/21 |
| 6,351,623 | B1 | 2/2002 | Thayer et al. | 399/258 |
| 6,416,158 | B1 | 7/2002 | Floyd et al. | 347/21 |
| 6,416,159 | B1 | 7/2002 | Floyd et al. | 347/21 |
| 6,439,711 | B1 | 8/2002 | Carlini et al. | 347/100 |
| 6,454,384 | B1 | 9/2002 | Peeters et al. | 347/21 |
| 6,467,862 | B1 | 10/2002 | Peeters et al. | 347/7 |
| 6,467,871 | B1 | 10/2002 | Moffat et al. | 347/21 |
| 6,499,831 | B2 | 12/2002 | Schmidlin | 347/55 |
| 6,511,149 | B1 | 1/2003 | Peeters et al. | 347/21 |
| 6,521,297 | B2 | 2/2003 | McDougall et al. | 347/20 |
| 6,523,928 | B2 | 2/2003 | Peeters et al. | 347/21 |
| 6,598,954 | B1 | 7/2003 | Moffat et al. | 347/21 |
| 6,719,399 | B2 | 4/2004 | McDougall et al. | 347/21 |
| 6,751,865 | B1 | 6/2004 | Peeters et al. | 347/21 |

OTHER PUBLICATIONS

U.S. Appl. No. 10/960,593, filed Oct. 2006, Lean et al.*

* cited by examiner

*Primary Examiner*—Juanita D. Stephens
(74) *Attorney, Agent, or Firm*—Fay Sharpe LLP

(57) ABSTRACT

Various systems and techniques are disclosed for stopping, selectively controlling, and optimizing a flow of particles in a flowing stream. The systems and techniques utilize a multi-electrode assembly and various voltage waveforms applied to those electrodes. The particles flow past or near the electrode assembly and their flow is controlled by the configuration and arrangement of the electrodes and the voltage waveforms applied thereto. An additional strategy for countering particle leakage flow is also described.

10 Claims, 26 Drawing Sheets

ELECTROSTATIC GATING

BACKGROUND

The present exemplary embodiment relates to gating electrodes and strategies for governing the flow of particles through or past the electrodes. It finds particular application in conjunction with the printing arts, and will be described with particular reference thereto. However, it is to be appreciated that the present exemplary embodiment is also amenable to other like applications such as pharmaceutical processing of medication in powder form.

BRIEF DESCRIPTION

In accordance with one aspect of the present exemplary embodiment, a system is provided for selectively controlling particle flow. The system comprises a passage adapted for housing the flow of a gas therethrough, in which the passage defines an inlet and an outlet. The system also comprises a particle container. And, the system comprises a branch conduit providing communication between the passage and the particle container. The branch conduit provides communication with the passage at a location between the inlet and the outlet. The system also comprises a gating assembly defining an aperture in which the gating assembly is disposed in the branch conduit. The gating assembly includes a first electrode and a second electrode adapted to emit electric fields proximate to a particle flow traveling through the aperture.

In accordance with another aspect of the present exemplary embodiment, a method is provided for stopping particle flow from a particle source through a flowing medium. The method is performed in a system comprising (i) a passage adapted for housing a flowing medium, (ii) a particle source, and (iii) a conduit providing communication between the passage and the particle source, wherein as a result of the flowing medium in the passage, particles from the particle source are drawn toward the flowing medium. The method comprises directing a minor flow from the flowing medium into the conduit to provide a counter flow to offset the flow of particles from the particle source to the flowing medium otherwise occurring.

In accordance with another aspect of the present exemplary embodiment, a method is provided for stopping particle flow from a particle source to a flowing medium in a system comprising (i) a passage adapted for housing a flowing medium, (ii) a particle source, and (iii) a conduit providing communication between the passage and the particle source, wherein as a result of the flowing medium in the passage, particles from the particle source are drawn toward the flowing medium. The method comprises providing an electrode assembly in the conduit such that particles flowing from the particle source to the passage, flow past and in close proximity to the electrode assembly. The method comprises also applying a 2 phase voltage waveform to the electrode assembly to selectively stop particle flow from the particle source to the passage.

In yet another aspect according to the present exemplary embodiment, a method for selectively controlling particle flow from a particle source to a flowing medium in a system comprising (i) a passage adapted for housing a flowing medium, (ii) a particle source, (iii) a conduit providing communication between the passage and the particle source, and (iv) an electrode assembly disposed in the conduit, the assembly including an entrance electrode and an exit electrode. The method comprises applying a variable voltage to the exit electrode whereby the particle flow from the particle source to the flowing medium is controlled by varying the voltage applied to the exit electrode.

BRIEF DESCRIPTION OF THE DRAWINGS

FIGS. 5A–5B illustrate another exemplary embodiment system, in which FIG. 5A is a top view and FIG. 5B is a side view.

DETAILED DESCRIPTION

The present exemplary embodiment relates to electrostatic gating electrodes, systems using such electrodes, methods of operating such electrodes, and techniques for governing or controlling the flow of particles past or in proximity to such electrodes. As to the use of the exemplary embodiment of gating electrodes in controlling particle flow, the electrodes can be used to stop particle flow and to selectively obtain specific rates of particle flow. In addition, the exemplary embodiment also relates to optimizing particle flow. Each of these aspects is described below. Although the descriptions are given with regard to toner particles, it will be understood that the exemplary embodiment includes applications to other types of particles. For example, it is contemplated that many of the aspects and features described herein are directly applicable in drug delivery or pharmaceutical processing systems.

Figure 1:
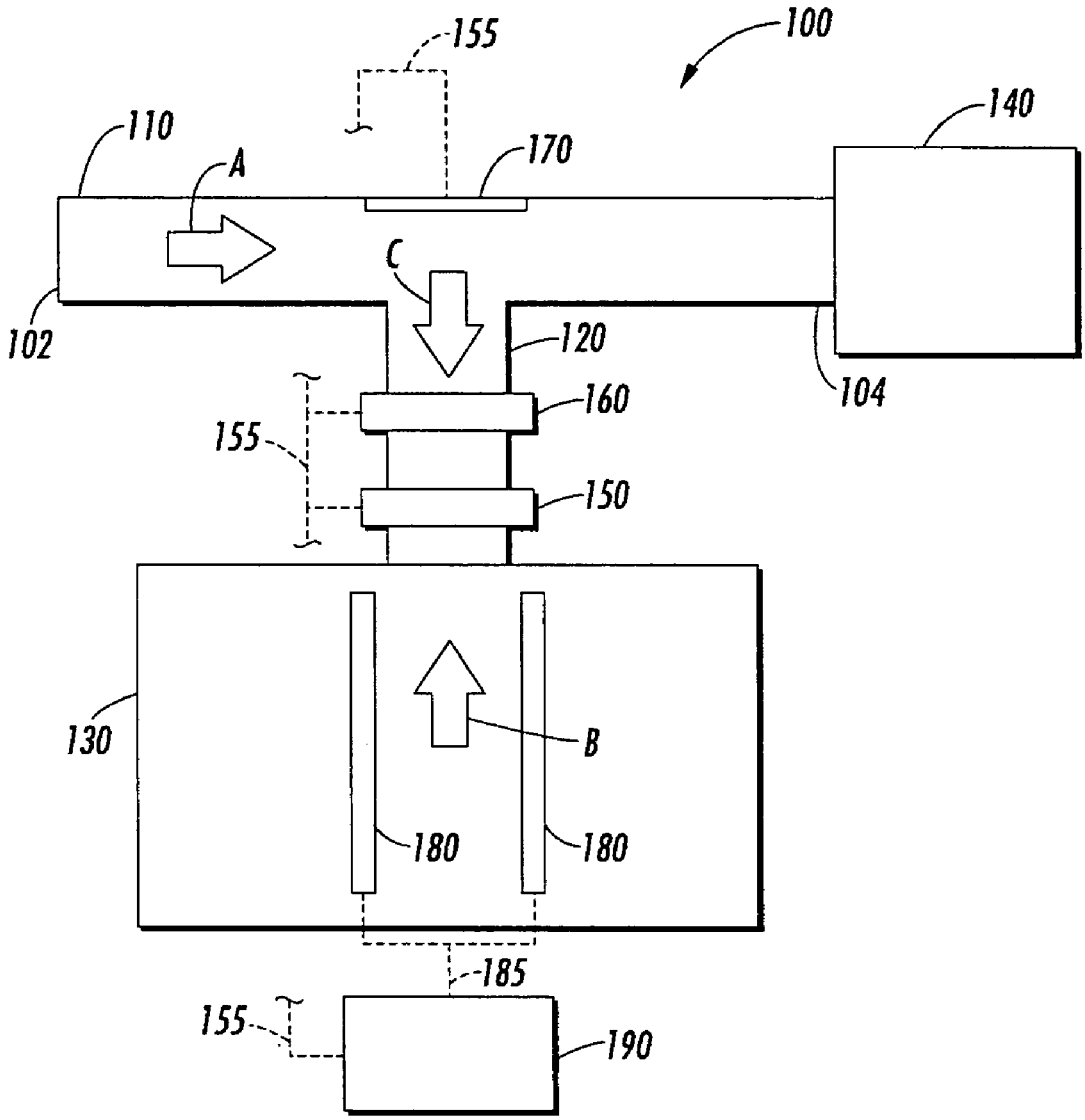
FIG. 1 is a schematic of an exemplary embodiment system.

FIG. 1 illustrates an exemplary embodiment system 100 comprising a flow passage 110 having an entrance 102 and an exit 104. The system also comprises a branching conduit 120 providing flow communication between the passage 110 and a toner or particle container 130. The flow passage 110 directs a flow of gases indicated by arrow A to a component 140 such as a print head. Disposed within the branching conduit 120 are a pair of apertured electrodes 150 and 160. Electrode 160 is sometimes referred to herein as an exit electrode. Electrode 150 is sometimes referred to herein as an entrance electrode. A third optional electrode 170 is disposed in the passage 110, generally in proximity to the entrance of conduit 120 from the passage 110, and/or in proximity to the exit electrode 160. Electrodes 150, 160, and 170 are described in greater detail herein.

Disposed within the particle container 130 are one or more traveling wave grids 180 that facilitate transport of powder or toner in the container 130 to the electrodes 150 and 160. Transport of such particles is indicated by arrow B. Although system 100 is described as utilizing traveling wave grids, the use of such grids is not required in the system. The term traveling wave grid as used herein collectively refers to a substrate, a plurality of electrodes to which a voltage waveform is applied to generate the traveling wave(s), and one or more busses, vias, and electrical contact pads to distribute the electrical signals (or voltage potentials) throughout the grid. The term also collectively refers to one or more sources of electrical power, which provides the multi-phase electrical signal for operating the grid. The traveling wave grids may be in nearly any form, such as for example a flat planar form, or a non-planar form. Traveling wave grids, their use, and manufacture are generally described in U.S. Pat. Nos. 6,351,623; 6,290,342; 6,272,296; 6,246,855; 6,219,515; 6,137,979; 6,134,412; 5,893,015; and 4,896,174, all of which are hereby incorporated by reference.

Generally, upon flow of a medium such as gas in the passage 110, shown as arrow A, particles from the container 130 are drawn into that flow and thus entrained within it. Flow of particles in this manner are in the direction of arrow B and in a direction opposite to flow C, described in greater detail herein. The system 100 also comprises a controller 190 which generally powers and/or controls the operation of the traveling wave grids 180 by signal and/or power lines 185 and thereby govern the rate of delivery of particles to the flow A. In addition, the controller 190 can power and/or control the operation of electrodes 150, 160, and 170 by the power and/or signal line 155. Generally, line 155 provides a desired voltage potential to each of the electrodes 150, 160, and 170.

The gating electrodes such as electrodes 150 and 160 in FIG. 1 are generally included in a gating assembly that defines an aperture through which the flow of particles is governed. The gating assembly generally defines an aperture between the two electrodes which are annular in shape. One electrode is positioned upstream of the aperture and the other is positioned downstream. The exemplary embodiment is in no way limited to this arrangement however. The size or span of the aperture, i.e. the size of the opening, depends upon the particular application and characteristics of the particles and flowing medium. However, the exemplary embodiment generally includes apertures having a diameter of from about 25 μm to about 75 μm, with 50 μm being typical. The exemplary embodiment includes apertures with significantly larger openings, such as for example, greater than 75 μm, greater than 150 μm, greater than 250 μm, and greater than 500 μm.

As noted, the exemplary embodiment provides various strategies for selectively stopping particle flow, controlling particle flow, and optimizing particle flow. Each of these strategies are described as follows. Again, it will be understood, that although the exemplary embodiment is described in terms of the printing arts and transporting toner particles, it is to be understood that the exemplary embodiment includes other applications involving the storage, transport, or distribution of minute particles.

Stopping Particle Flow

At least three mechanisms have been identified to terminate or otherwise stop toner flow during idle periods for a printer, such as a ballistic aerosol marking (BAM) printer. Termination of such flow is sometimes necessary as the aperture in certain toner print systems exhibits leakage flow due to toner self-field. Details and information relating to ballistic aerosol marking systems, components, and processes are described in the following U.S. Pat. Nos. 6,751,865; 6,719,399; 6,598,954; 6,523,928; 6,521,297; 6,511,149; 6,467,871; 6,467,862; 6,454,384; 6,439,711; 6,416,159; 6,416,158; 6,340,216; 6,328,409; 6,293,659; and 6,116,718; all of which are hereby incorporated by reference.

One method of terminating toner flow achieves an equilibrium balance between the hydrodynamic drag and Coulomb force by allowing a slow bleed gas flow from the main channel into the toner cavity, such as shown by arrow C in FIG. 1. This offsets or counters leakage flow otherwise occurring. This method as described herein achieves a hydrodynamic/electrostatic force balance. Two other methods of terminating toner flow rely on the application of electrode voltages for several cycles to two phase gates, which can be in the form of electrodes, such as electrodes 150 and 160. In one of these methods, the polarity of the exit electrode is reversed to impede toner flow. In another method, the polarity of both the entrance and the exit electrodes are reversed to fully prevent toner flow.

Concerning the method utilizing a hydrodynamic/electrostatic force balance, a relatively minor flow of medium, such as gas, is directed to a flow orifice positioned within the flow path of particles when entering the high velocity gas stream for subsequent delivery or deposition. The minor flow of gas passes through the flow orifice thereby blocking or otherwise countering the flow of particles otherwise occurring through the orifice. The particle flow can be balanced with relatively small amounts or velocities of the minor flow through the orifice. In certain versions of the exemplary embodiment systems, a gating electrode assembly provides or serves as the flow orifice.

As to the application of electrode voltages for gating, previously known electrostatic gating implementations used up to four electrodes. These systems used 3 or 4 phase traveling wave systems for toner transport. One significant improvement, in accordance with the exemplary embodiment, involves the use of 2 phase gating, which is particularly efficient. The reason for the increased efficiency is that the aspect ratio of aperture height to aperture width becomes smaller and therefore makes it easier for toner to pass through the small but shorter aperture. Furthermore a reduction to 2 phase gating significantly simplifies fabrication. For 50 um apertures, only very low agglomeration or "fluffy" 6 um toner can be admitted through the aperture. This has subsequently been verified using a Minco grid for traveling wave transport of the toner with 90 degree coupling to the aperture. The aperture can be fabricated from an Au coated 2 mil Kapton film with a laser-drilled 50 um hole. A 4 phase circuit is used to drive the traveling wave to transport the toner. The fluidized toner is gated through a 2 phase aperture by electrostatic forces. Toner is gated using two sequential phases of the 4 phase system for transport. Cyan EA toner gated from a supply is deposited on an upper exit electrode surface around the 50 um aperture. It will be appreciated that these parameters are merely representative, and that the exemplary embodiment encompasses a wide array of system configurations.

It should be noted that planar toner transport requires a minimum of 3 phase excitation to provide directionality to cloud motion. That is, any voltage combination will transport any of the toner polarity combinations equally well for the same electric (E) field levels. The fundamental mechanism is that positive toner is pushed in front of a positive pulse while negative toner is pulled behind the positive pulse and vice versa. The difference introduced by aperture gating is the asymmetry due to the geometry. For example, a positive entrance electrode voltage acts to repel positive toner while loading the aperture with negative toner. This action affects the next half-cycle as less positive toner is now available in the vicinity for gating.

Figure 2A:
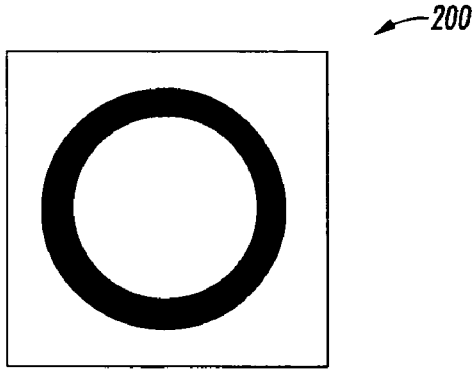
FIGS. 2A–2D illustrate particle flow in another exemplary embodiment system.
Figure 2B:
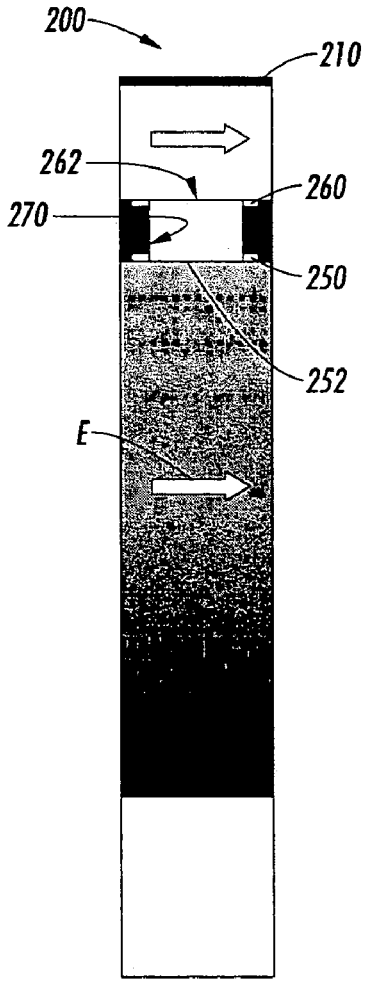
Figure 2D:
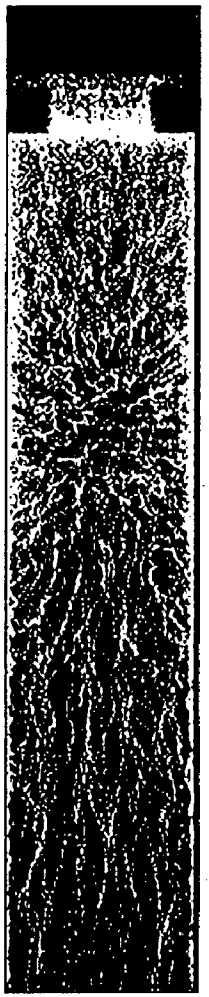
Figure 2C:
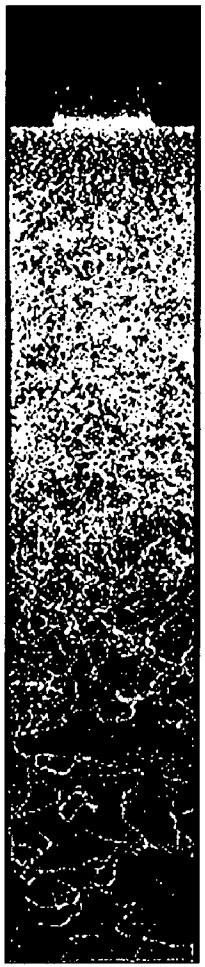

FIGS. 2A–2D illustrate the geometry of a cross-section of toner flow in an exemplary embodiment system 200 where toner is gated upwards through an aperture 270 into a gas channel 210 for entrainment and eventual deposition onto a print medium (not shown). Gating electrodes 250, 260 are in the form of two annular rings defining an entrance 252 and an exit 262 of aperture 270. Electrode 260 is an exit electrode as described in greater detail herein. A finite layer of toner with a prescribed volume density is located at a specified distance from the aperture, and moves with a traveling wave velocity in the direction of arrow E. For any given density, a finite number of toner particles corresponding to the cell dimension are randomly seeded within the toner cloud. Gated toner is continually replenished to maintain constant cloud density. FIG. 2C shows a tracer plot of bipolar toner motion. FIG. 2D shows the corresponding tracer plot for unipolar toner. Unipolar toner in FIG. 2D suffers mutual repulsion leading to rapid cloud expansion. In a bias field, the cloud also drifts toward the electrode of the opposite polarity.

Figure 3A:
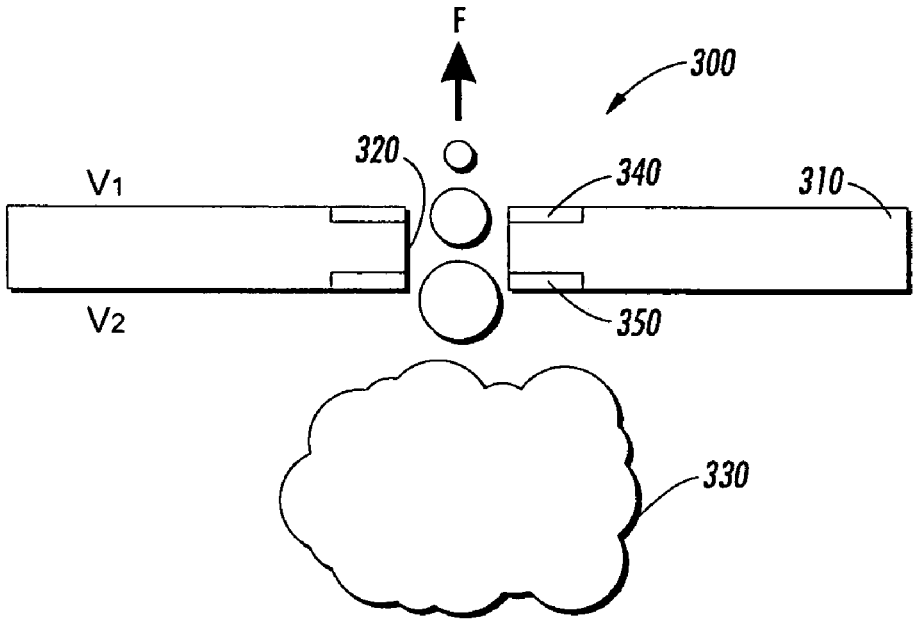
FIG. 3A is a schematic of another exemplary embodiment system.
Figure 3B:
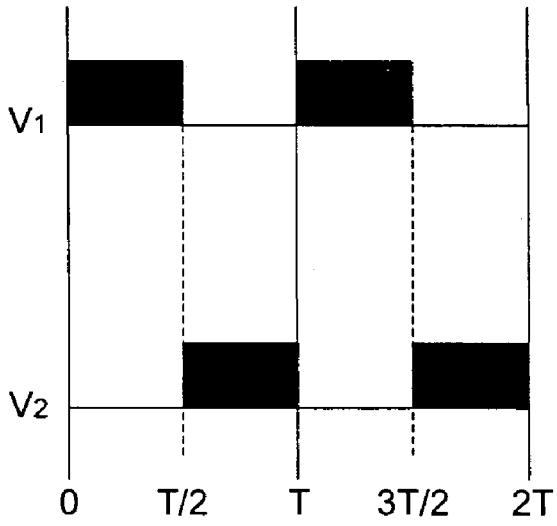
FIG. 3B is a voltage waveform that can be used in the exemplary embodiment systems.

FIG. 3A shows another illustration of a system 300 having a particular gating geometry with the switching voltage waveforms in FIG. 3B. Specifically, system 300 comprises a gating aperture assembly 310 that defines an aperture 320 through which particles such as toner are passed. Generally, the particles are in the form of a particle cloud 330. Particles are drawn from the cloud, into the aperture 320, and exit the aperture assembly 310 in the direction of arrow F. The aperture assembly 310 includes an electrode 340 and another electrode 350 spaced from the electrode 340. Electrode 340 is an exit electrode as described in greater detail herein. Generally, the electrodes 340 and 350 are in the form of annular flat rings, however the exemplary embodiment encompasses a wide array of other electrode shapes, forms, and configurations. The electrodes 340 and 350 are at different voltages $V_1$ and $V_2$, respectively, as described in greater detail herein. In FIG. 3A, $V_1$ is used to denote the exit voltage. In all other figures and descriptions herein, $V_2$ denotes exit voltage. FIG. 3B depicts an exemplary pulsing voltage waveform applied to the electrodes 340 and 350 for selectively withdrawing particles from cloud 330 in the direction of arrow F.

Toner of either polarity in proximity to an aperture will continue to gate even when the electrodes are grounded due to the toner self-field. This phenomena leads to a slow leakage flow which may be undesirable when precise toner metering is important. In the present exemplary embodiment, several strategies are described to shut off the leakage flow during idle periods. As noted, these strategies involve force balancing using a flowing medium and/or application of voltages to gating electrodes. These configurations are simulated using parameters listed in Table 1, as described in greater detail herein.

TABLE 1

Simulation and computed parameters

| Parameter | Description | Nominal Value |
|---|---|---|
| r | Toner radius <um> | 2.9 |
| m | Toner mass <gm> | $8.2852 \times 10^{-11}$ |
| Vtoner | Toner volume <mm$^3$> | $1.0216 \times 10^{-7}$ |
| q | Toner charge <C> | $3.07 \times 10^{-15}$ |
| $\rho_m$ | Material density <gm/cm$^3$> | 0.811 |
| q/m | Charge/mass ratio <uC/gm> | 37.0540 |
| q/d | Charge/diameter ratio <uC/cm> | $5.2931 \times 10^{-6}$ |
| n | Initial toner supply <#/cell volume> | 400 |
| $V_{gate}$ | Gating Voltage <V> | 400 |
| $\Delta t$ | Time-step <s> | 5.0 μs |
| $f_{gate}$ | Gating frequency <Hz> | 1000 |
| nV | Volume density <%> | 1.8854 |
| $n_g$ | Gating rate <#/s> | 600,000 |
| $n_g m$ | Gated mass per second <μg/s> | 49.7112 |
| $dn_g/dV$ | Gated toner per Volt.second | 1500 |
| h | Pixel size <um> @300 spi (w = h) | 85 |
| $V_{media}$ | Print media velocity <cm/s> | 2.54 |
| pma | Printed mass/area @$v_{media}$ <mg/cm$^2$> | 2.3160 |
| t | Thickness of printed toner @$v_{media}$ <um> | 28.5573 |

Figure 4:
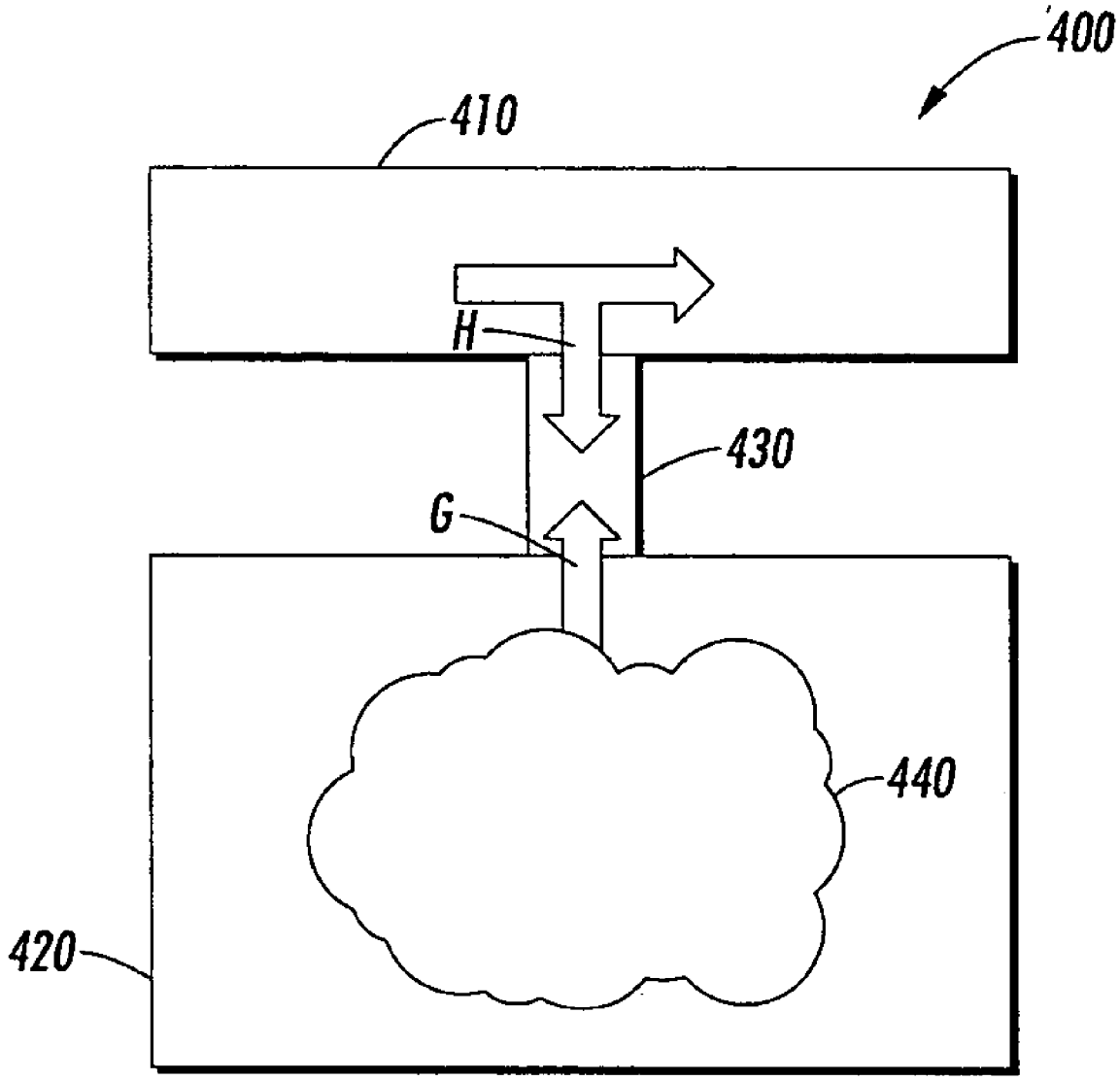
FIG. 4 is a schematic of another exemplary embodiment system.

FIG. 4 depicts a system 400 utilizing a hydrodynamic/electrostatic force balance in the aperture that may be used to shut off toner flow. System 400 comprises a gas transport passage 410, a particle container 420, and a branch conduit 430 providing flow communication between the passage 410 and the container 420. A gating aperture with electrodes as previously described (not shown) is disposed in the conduit 430. Particles, such as in a particle cloud 440, can be withdrawn from the container 420 through the conduit 430 and into the passage 410, in the direction of arrow G. After termination of a primary flow in passage 410, as noted, leakage flow may still occur. The leakage flow due to the toner self-field attempts to move the particles from the container 420 up through the conduit 430 into the passage 410 above in the direction of arrow G. This may be off-set by allowing a slow bleed of gas flow from the passage 410 to the conduit 430 in the direction of arrow H.

Figure 5A:
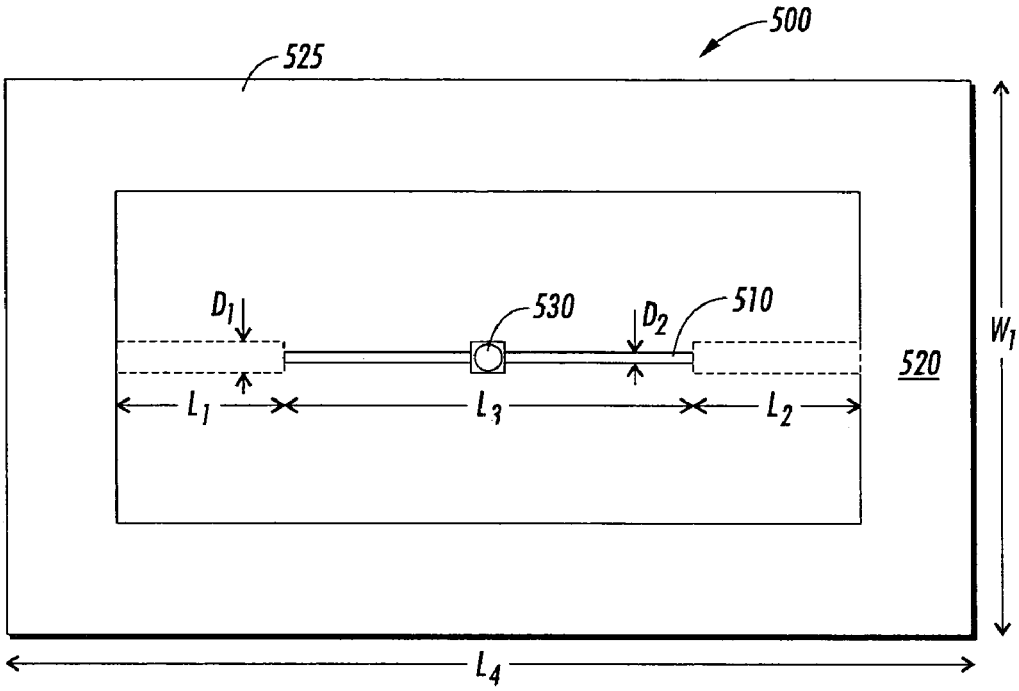
Figure 5B:
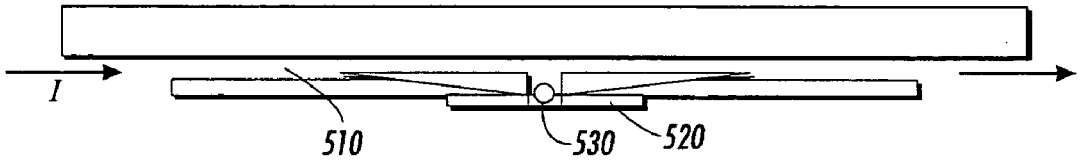

FIGS. 5A–5B show an exemplary embodiment system 500 utilizing this strategy of achieving a hydrodynamic/electrostatic force balance. FIG. 5A is a top view of the system 500, and FIG. 5B is a side view of that system. The system 500 comprises a passage 510 through which gas flow I passes. A gating assembly 520 defining an aperture 530 is disposed in flow communication with the passage 510. The dimensions of the passage 510 are as follows. Entering gas flow I enters a first region of the passage 510 in which the span or diameter of the passage, noted as $D_1$ in FIG. 5A, is 1.0 mm and 9.0 mm in length, noted as $L_1$. Gas flow then enters an intermediate region of the passage 510 having a span or diameter $D_2$ of 0.5 mm and a length $L_3$ of 20 mm. Gas flow then enters a third region of the passage 510 having a span or diameter the same as $D_1$ and a length $L_2$, which is the same as $L_1$. The dimensions of a plate 525 used in the assembly 520 are 50 mm in length $L_4$, and 26 mm in width $W_1$. The 50 um gating aperture 530 is formed by laser-drilling through 2 mil Kapton film which is then mounted onto an aperture plate. Fluent is used to develop a flow analysis for 10 psi pressure entering the passage 510. It will be appreciated that these parameters are merely representative, and that the exemplary embodiment encompasses a wide array of system configurations.

Figure 6:
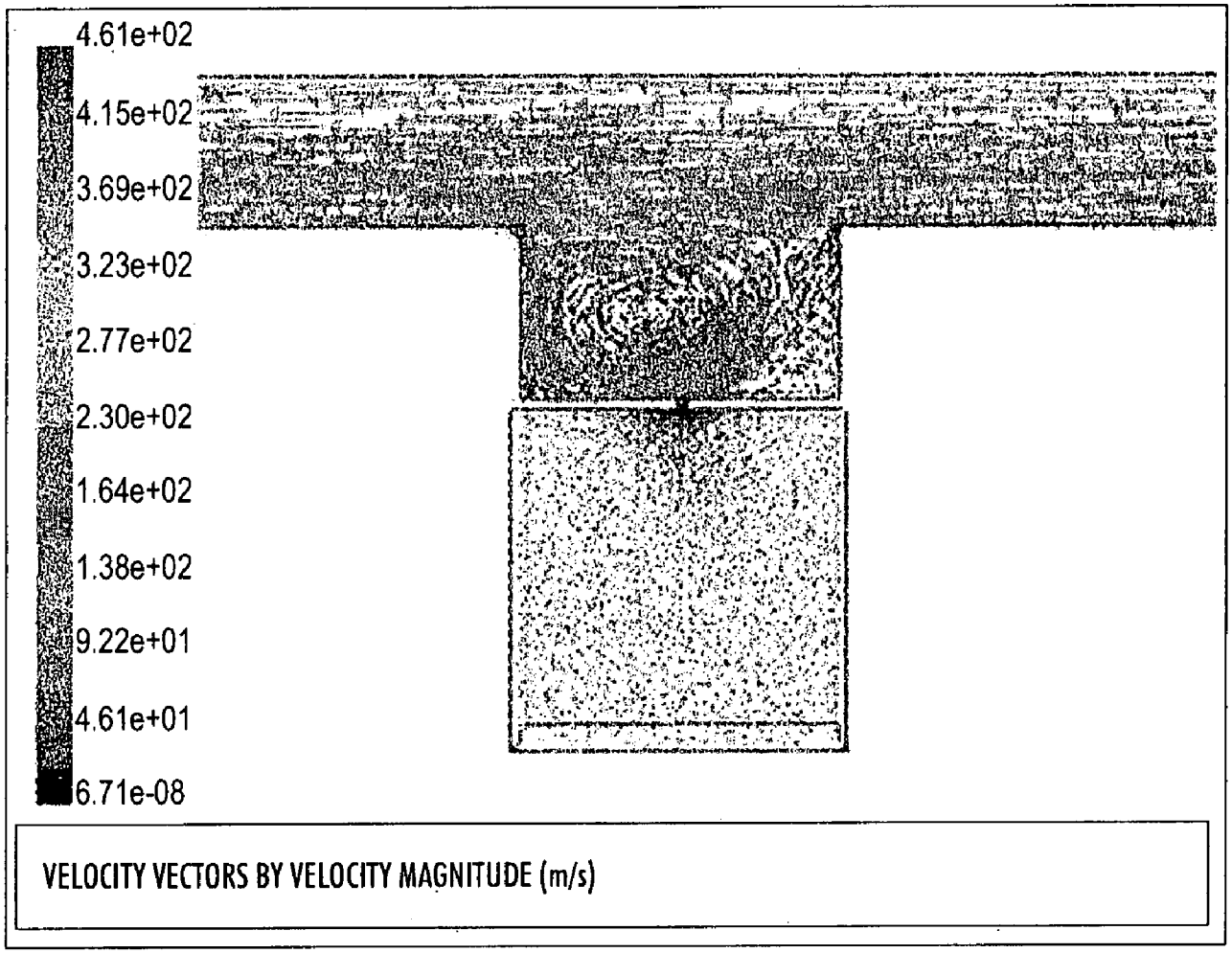
FIG. 6 is a graph illustrating velocity vectors of gas flow in a channel-aperture region of the system depicted in FIGS. 5A–5B.

FIG. 6 shows the velocity vectors in the channel-aperture region of the system 500 of FIGS. 5A–5B.

Figure 7:
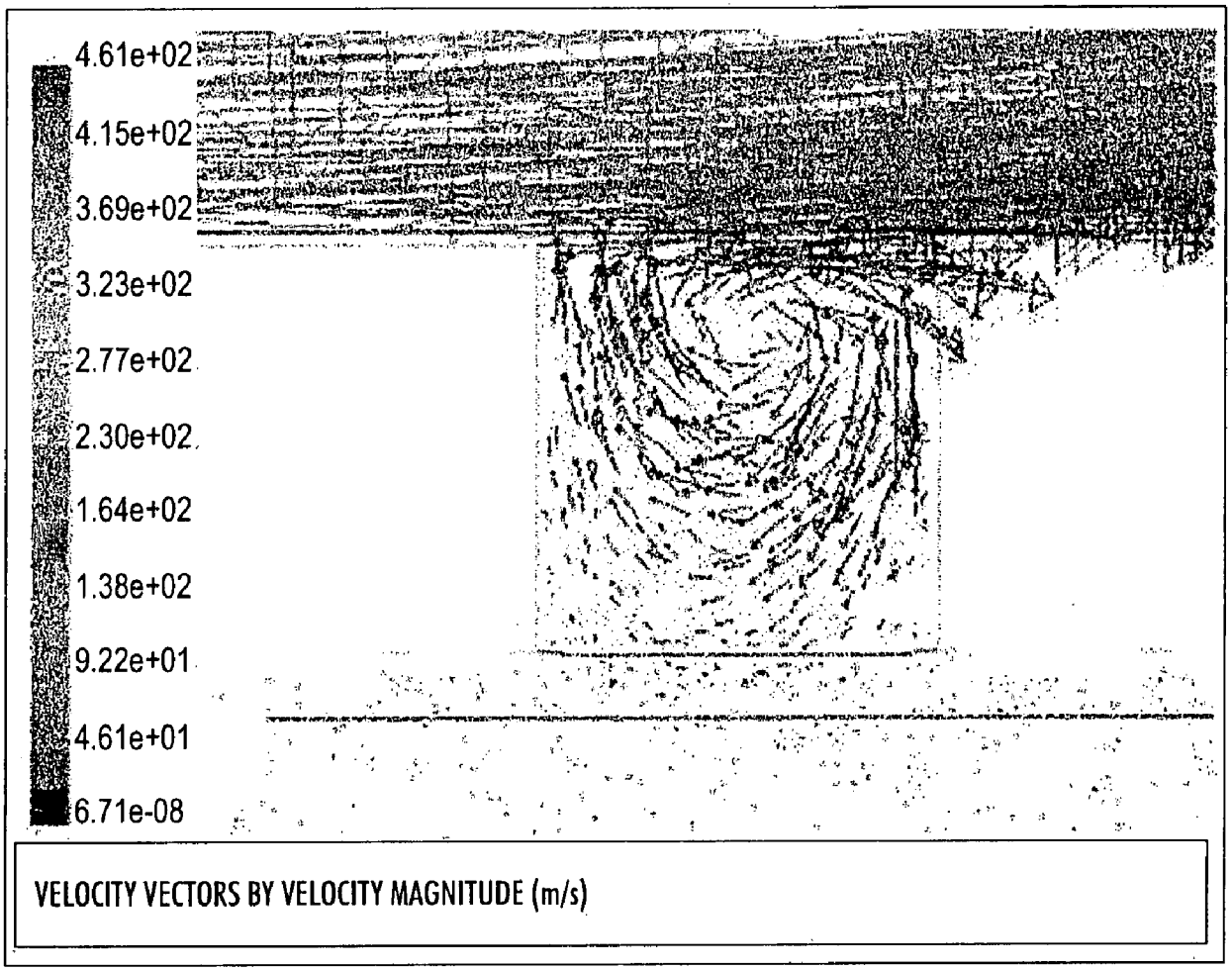
FIG. 7 is a graph detailing a particular region of flow shown in FIG. 6.

An enlarged view of the velocity vectors in the aperture is shown in FIG. 7. A vortex is evident that creates a re-circulation even in the very small 50 um region.

Figure 8:
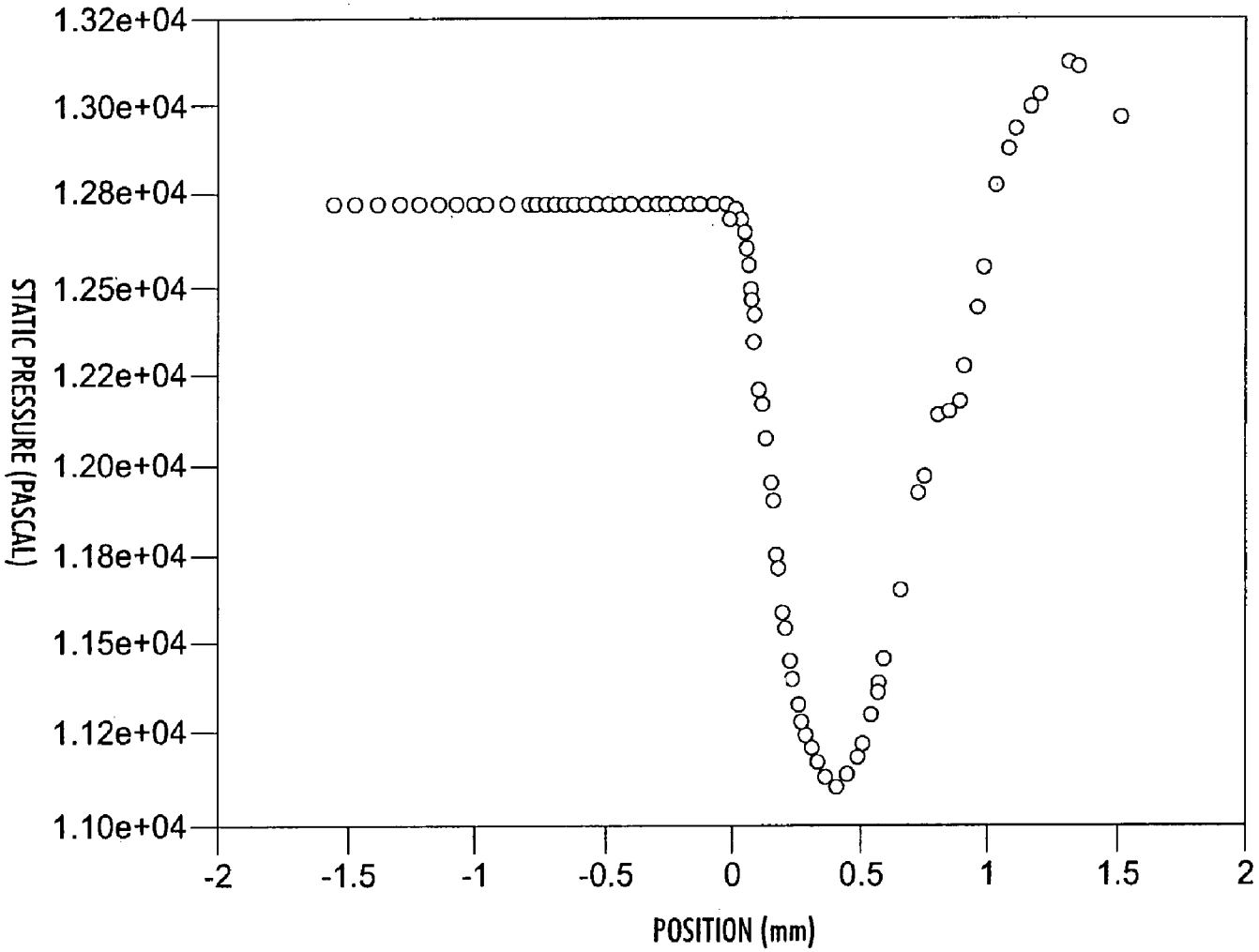
FIG. 8 is a graph illustrating pressure as a function of position through the aperture in the system of FIGS. 5A–5B.

FIG. 8 shows the small pressure drop through the aperture of the system 500 of FIGS. 5A–5B.

Figure 9:
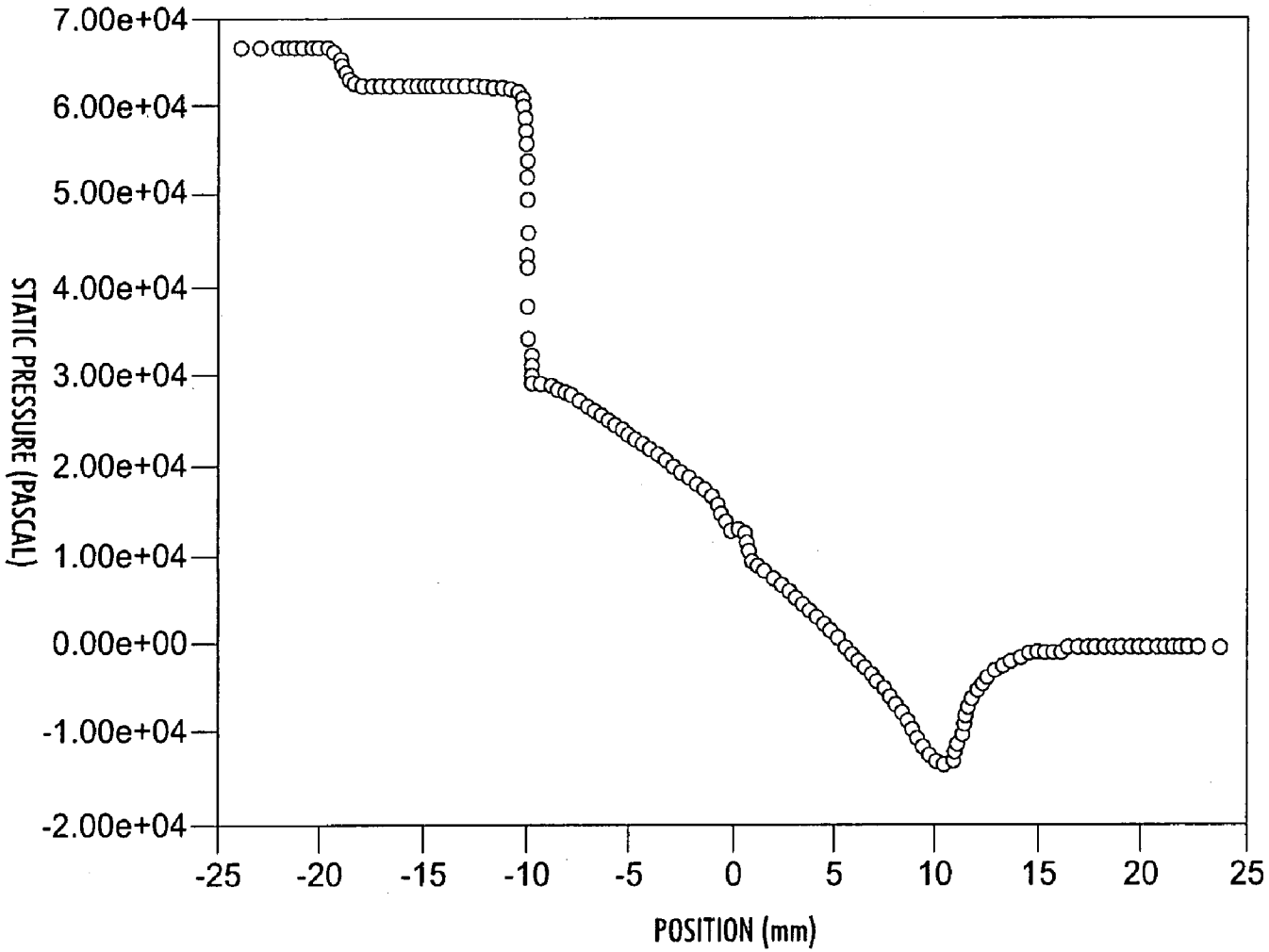
FIG. 9 is a graph illustrating pressure as a function of position along the channel in the system of FIGS. 5A–5B.

FIG. 9 shows the corresponding pressure drop along the channel with the largest linear drop within the 20 mm span that includes the aperture region for the system 500. A 3D electrodynamic model is used to track toner gating subject to a superimposed (assumed) laminar flow of gas in the opposite direction. This slow flow constitutes drag to balance the Coulomb forces on the toner.

Figure 10:
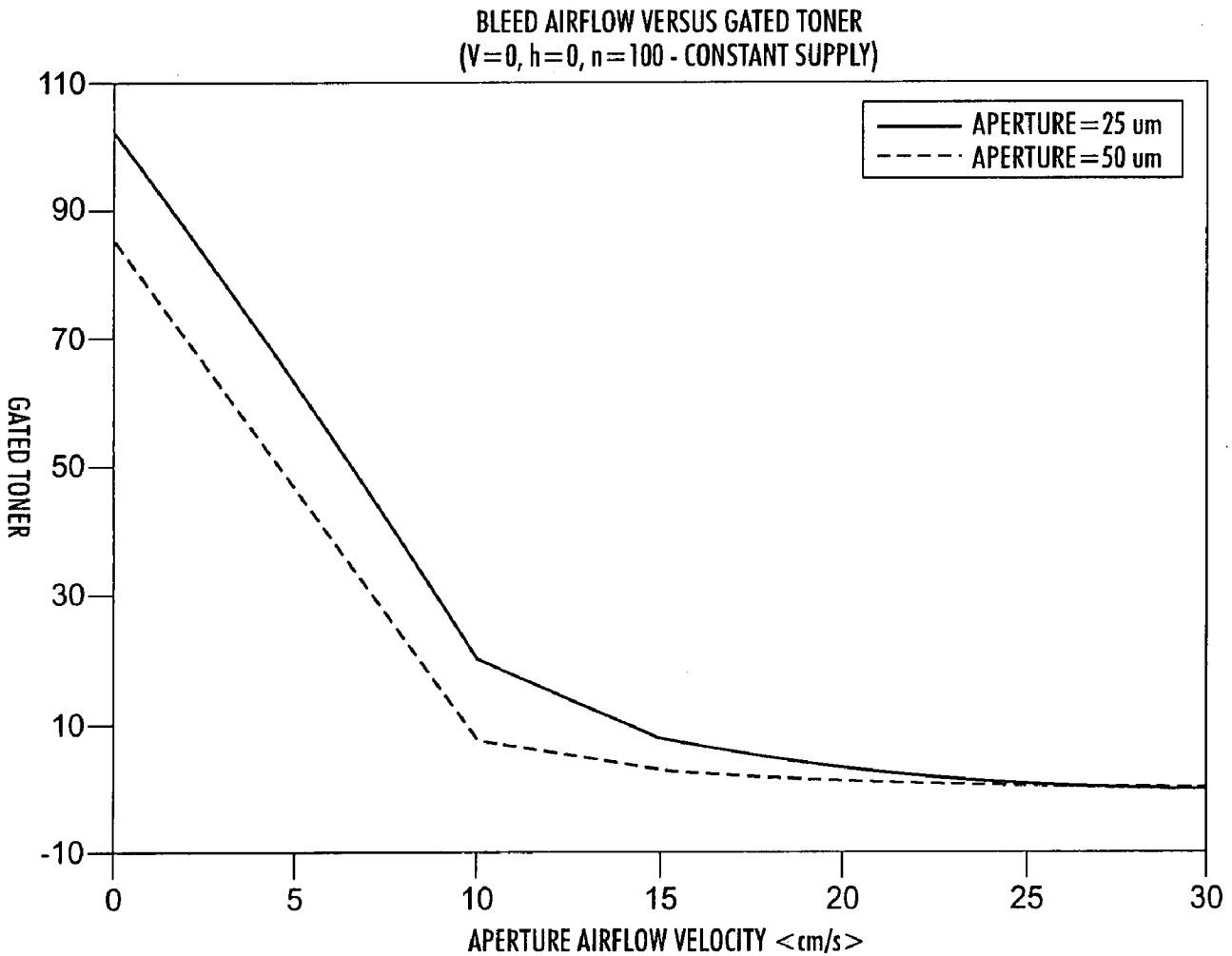
FIG. 10 is a graph illustrating bleed airflow of gated toner through two differently sized apertures as a function of aperture airflow velocity.

Gating curves in FIG. 10 are for 25 μm and 50 μm apertures drilled in 1 and 2 mil Kapton films. The curves show that for this set of parameters, toner flow can be balanced with 10 to 20 cm/s flow of gas through the very narrow 50 μm aperture (dashed line), requiring very low pressure differentials in the range of $0.6–2.4\times10^{-2}$ Pa.

Figure 11:
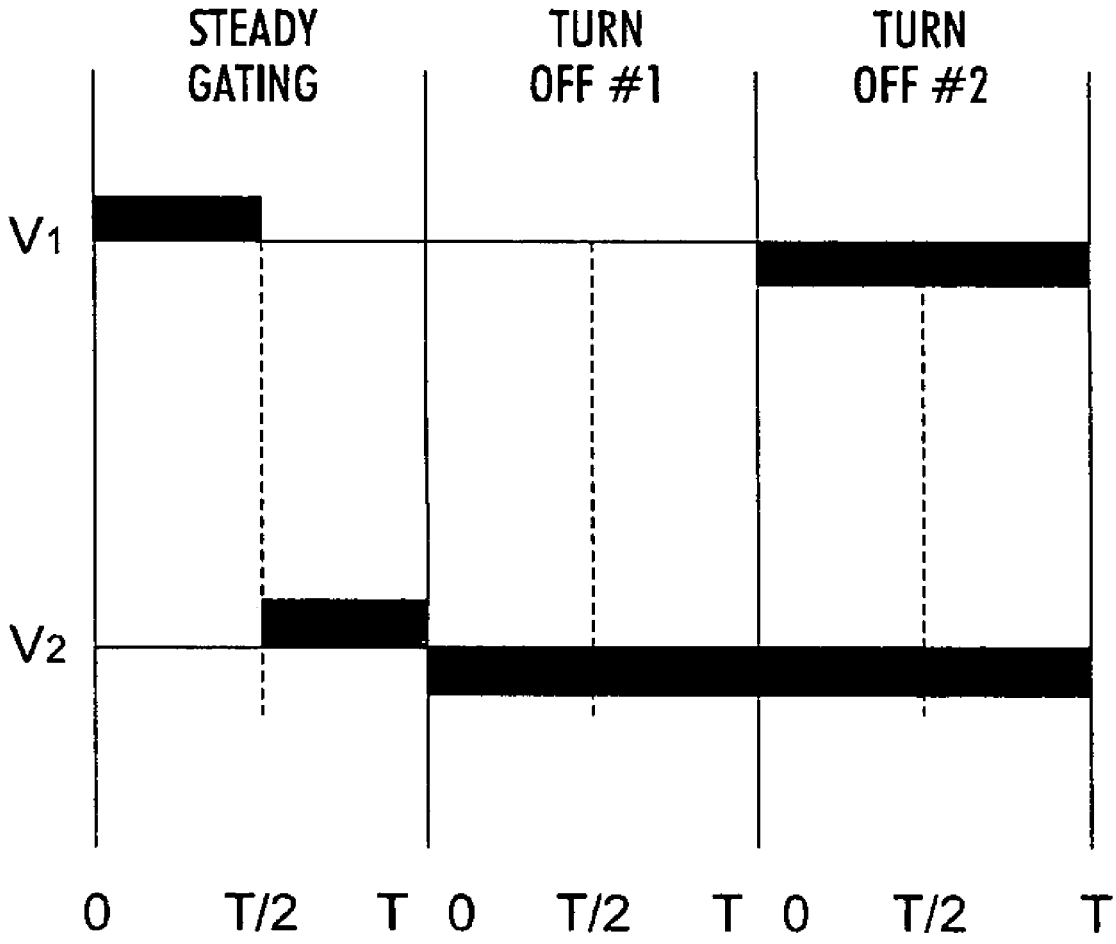
FIG. 11 is a graph of voltage waveforms for a pair of electrodes utilized for terminating particle flow.

An alternative strategy to stop leakage particle flow during an idle state is to set up a reverse electric field using the entrance and exit electrodes such as electrodes 150 and 160 in FIG. 1. Exemplary voltage patterns for one cycle are shown in FIG. 11. For steady gating, the electrode voltages are those used for 2 phase action and pumps particles such as toner as shown in the first portion of FIG. 12. At 1 kHz, the rise time constant is less than 1 ms. Therefore, a gating time of 5 ms was used to allow the mechanism to achieve near steady-state operation. At 5 ms, the gating voltage patterns were turned off as in the second part of FIG. 11. The voltage of the exit electrode $V_2$ is inverted while the entrance electrode $V_1$ is grounded. This results in the top curve in FIG. 12, which is a plot of the gated toner fraction. As time increases, the ratio of gated (which is now very small or zero) toner to the supply drops showing a negative gradient.

Figure 12:
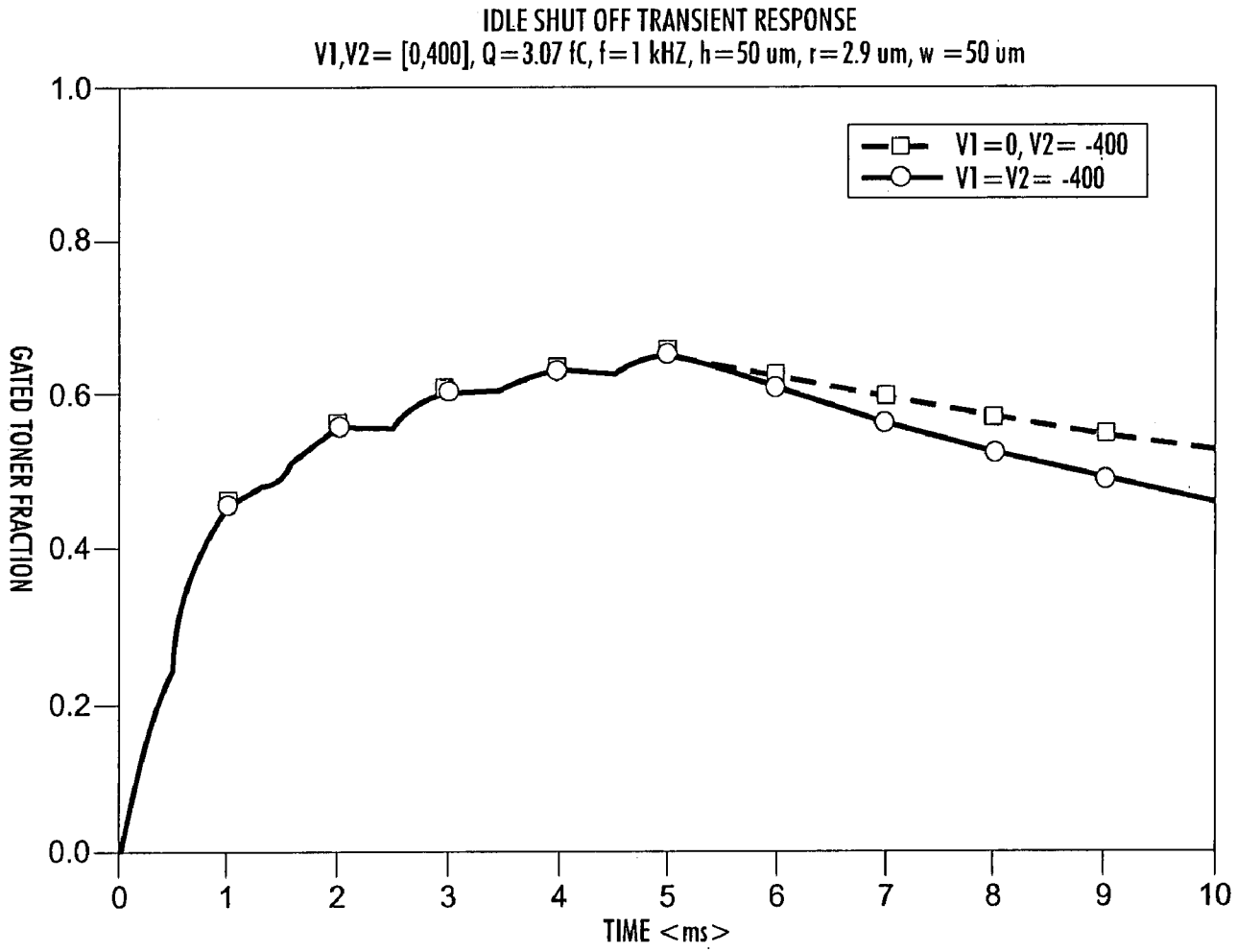
FIG. 12 is a graph of gated toner fraction as a function of time for two electrode configurations.
Figure 13:
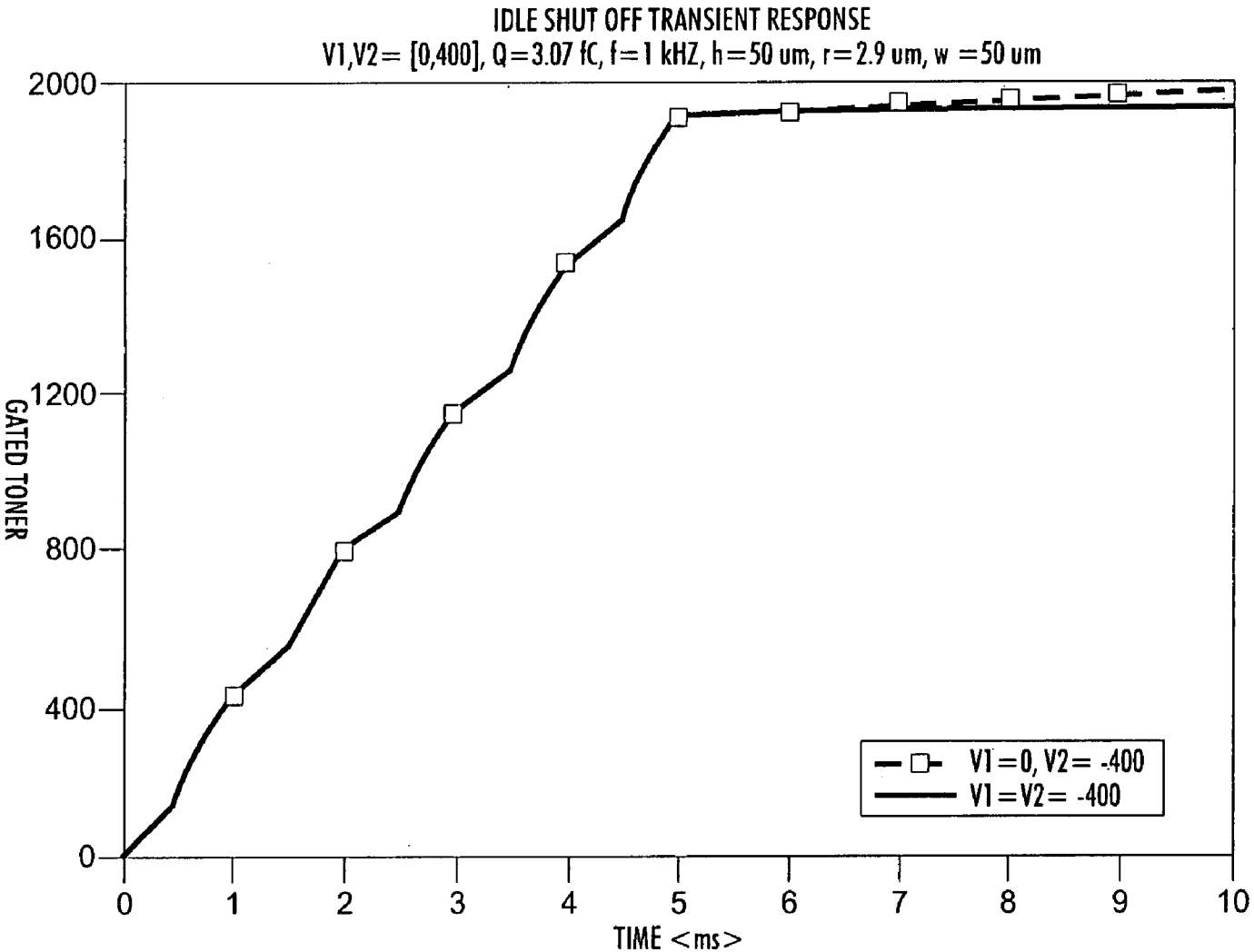
FIG. 13 is another graph of gated toner fraction as a function of time.

An extension of this strategy is to invert both entrance and exit electrode voltages $V_1$ and $V_2$ as shown in the third portion of FIG. 11. This has the effect of repelling all toner away from the aperture region. As expected, the shut-off action is more dramatic, as can be seen in FIG. 12. FIG. 13 shows another plot of gated toner as a function of time. This data clearly exhibits the steady gating of toner in the first 5 ms and the ensuing shutdown of the flow due to the two electrode voltage patterns. Both strategies work well for preventing toner leakage.

Controlling Particle Flow

A variable voltage scheme can be used to augment the on-demand 2 phase electrostatic gating particles, such as for example, of toner for a BAM printer. This method selectively adjusts the voltage of the exit electrode such as electrode 160 in FIG. 1, electrode 260 in FIG. 2B, or electrode 340 in FIG. 3A, to control mass flow rate, and therefore gray level printing. The additional benefit is to set up a reverse field, which prevents toner back-flow in the aperture during the second half-cycle. This reduced voltage also minimizes the attraction of gated toner to the exit electrode due to the self-field.

In this exemplary embodiment, a variable voltage scheme is utilized for the exit electrode of a BAM printer. The voltage of the exit electrode is selectively adjusted to control mass flow rate. The gating mechanism of the 2 phase configuration is a "pull-push" effort much like a two-stroke combustion engine. In the first half-cycle, opposite sign toner is pulled into the aperture by the inlet electrode. Then, in the second half-cycle, the toner is pushed through the aperture. This reduced voltage also minimizes gated toner attraction to the exit electrode due to the self-field.

Figure 14:
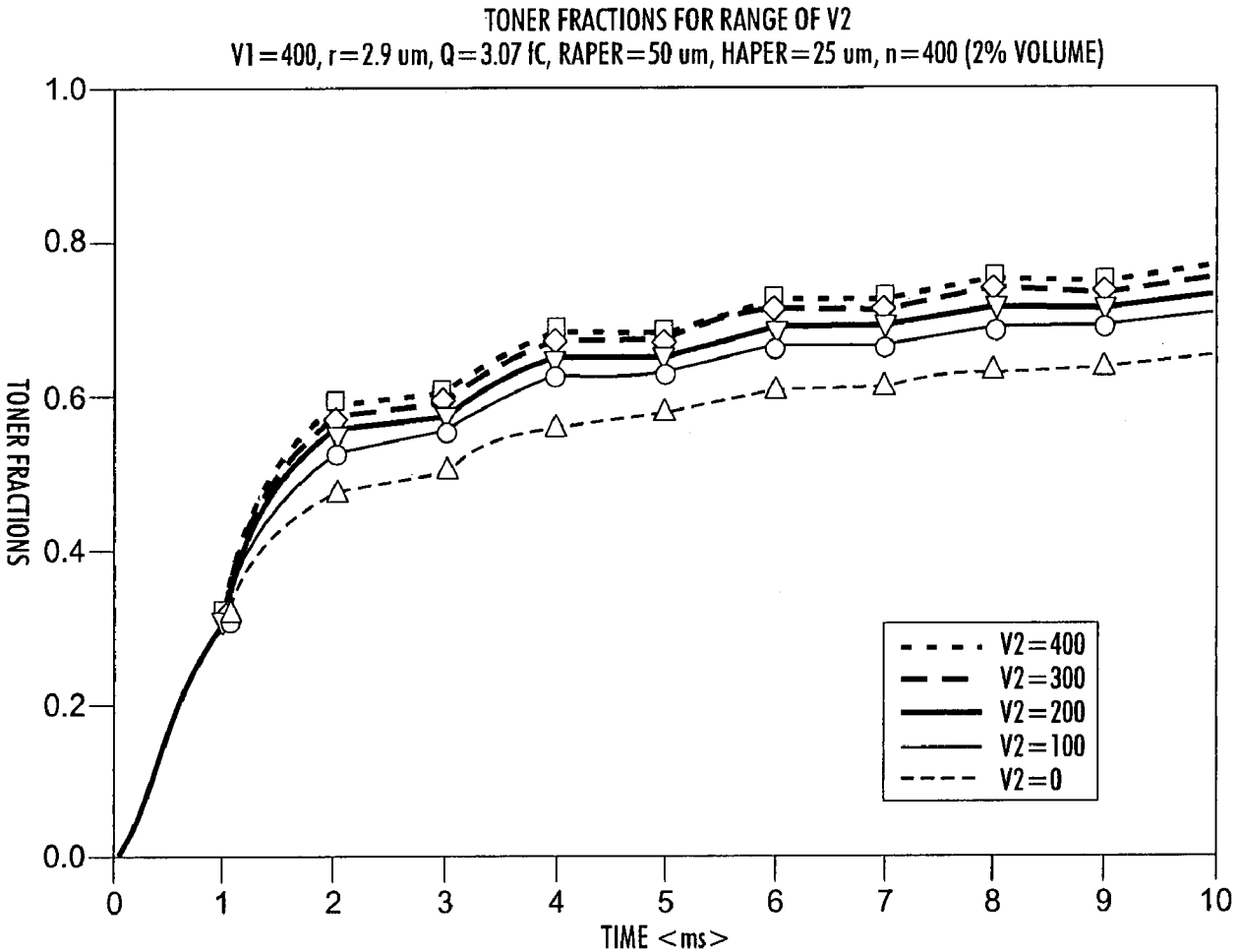
FIG. 14 is another graph of gated toner fractions versus time.
Figure 15:
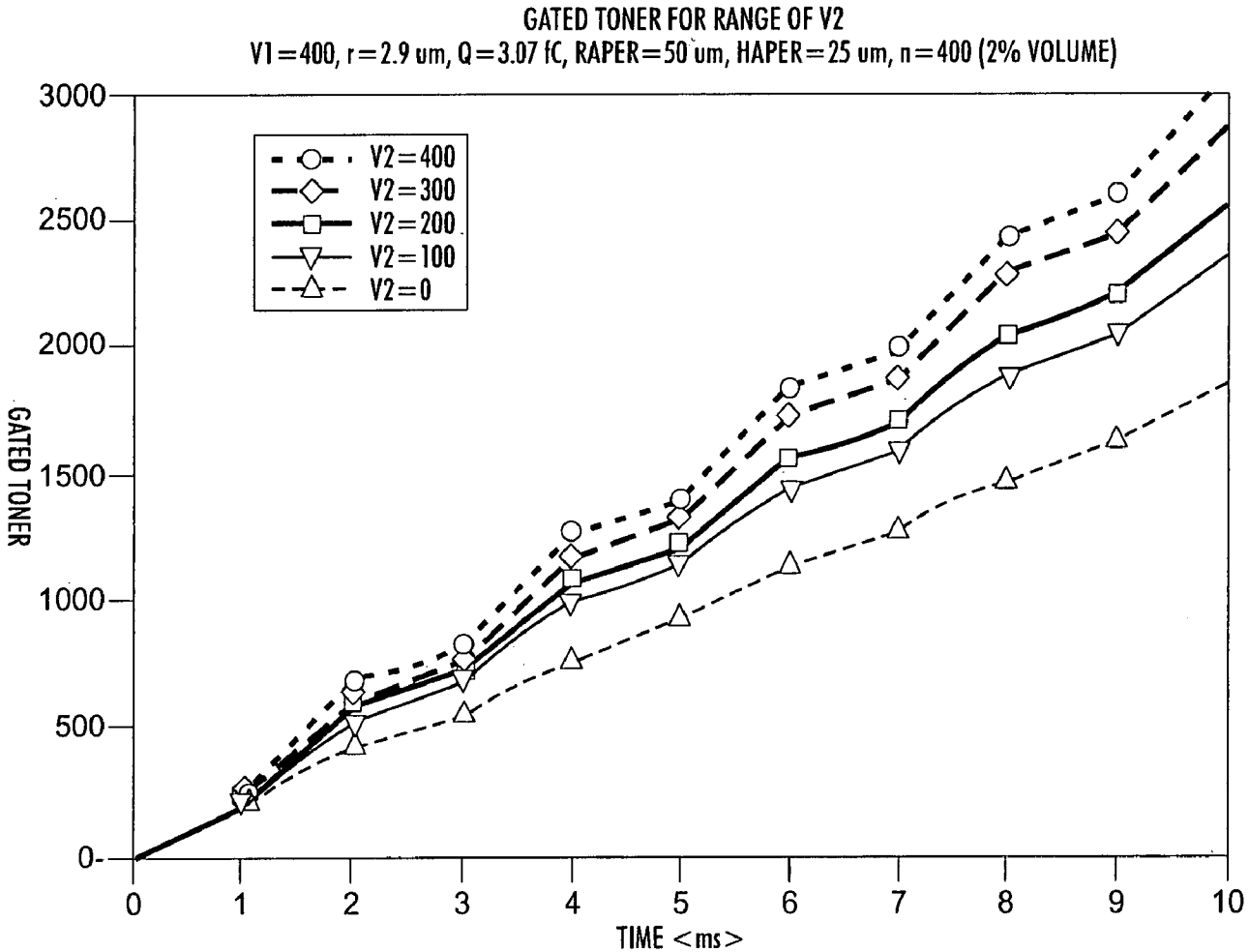
FIG. 15 is a graph of gated toner flow rate as a function of time.

This strategy is demonstrated by varying the voltage of the exit electrode and computing the throughput of dynamic gated toner. FIG. 14 shows a transient response of toner fractions over the first 5 ms time interval for negative toner gated with positive voltages. At a gating frequency of 1 kHz, the time constant is 1 ms so that this interval allows the curve to approach steady-state. The fraction of gated toner increases as the voltage of the exit electrode is increased from 0 to 400 V. This fraction measures efficiency of gating, and asymptotes with diminishing increments to some maximum as voltage is increased. A more linear indication is provided by the total mass flow rate curves shown in FIG. 15. Here, the increments from 100 V to 400 V are quite linear, except for the jump from 0V. As indicated earlier, the characteristic gating mechanism of the 2 phase configuration is a "pull-push" effort much like a two-stroke engine. The slope of the curve in the first half-cycle is less steep since the toner gated is only due to displacement of toner already in the aperture by toner pulled in from the inlet. The steeper slope of the curve for the second half-cycle includes both displacement and push from the exit electrode. Note also that the slopes of the curve for the first half-cycle are identical, as the exit electrode does not factor into the dynamics until the second half-cycle.

Table 2, set forth below, is a summary of toner flow rates for a range of exit electrode voltages.

TABLE 2

Toner Flow Rates for Range of Exit Electrode Voltages

| Exit Electrode Voltage | Toner Flow Rate <#/s> |
|---|---|
| 0 | 370,000 |
| 100 | 450,000 |
| 200 | 510,000 |
| 300 | 570,00 |
| 400 | 630,000 |

Optimizing Particle Flow

Another configuration is also provided for achieving maximum or optimal particle throughput with electrostatic gating. This 2 phase configuration uses switching voltages to selectively control and provide an optimal flow rate through a gated aperture. For the set of operating parameters set forth below, the performance of a two phase configuration is shown to be superior to both a 2 phase with a third DC electrode, and a 3 phase configuration. The reduction to 2 phase operation simplifies both fabrication and implementation steps.

Modeling is used to optimize the set of critical parameters. FIGS. 2A–2D show the geometry of a simulation cross-section where toner is gated upwards through an aperture into a gas channel for entrainment and eventual deposition onto a print medium. Gating electrodes are the two annular rings located at the entrance and exit of the aperture, such as electrodes 250 and 260 of aperture 270. A finite layer of toner with a prescribed volume density is located at a specified distance from the aperture, and moves with a traveling wave velocity to the right, as shown by the arrow E in FIG. 2B. For any given density, a finite number of particles corresponding to the cell dimension are randomly seeded within the toner cloud. Gated toner is continually replenished to maintain constant cloud density. FIG. 2C shows a tracer plot of bipolar toner motion. FIG. 2D shows the corresponding tracer plot for unipolar toner. Unipolar toner suffers mutual repulsion leading to rapid cloud expansion. In a bias field, the cloud also drifts toward the electrode of the opposite polarity. FIG. 3A shows another illustration of the gating geometry with the switching voltage waveforms shown in FIG. 3B.

The set of critical parameters considered include:

| | |
|---|---|
| Gating voltage | unipolar and bipolar voltages over 400 V range |
| Gating frequency | 1 kHz to 20 kHz (gating/writing frequency) |
| Transport frequency | 10 Hz to 1 kHz (wave velocity and cloud height is proportional to transport frequency for this "surfing" mode of motion) |
| Duty cycle | 25% for transport grid, 50% for gating |
| Toner charge | unipolar and bipolar EA toner |
| Voltage phases | 2-ϕ, 2-ϕ + DC(0), and 3-ϕ gating configurations |
| Aperture height | 1 or 2 mil (Kapton film thickness) |

Simulation runs were performed including combinations of the matrix of preceding parameters together with other detailed data shown in Table 1. Post-computation of the electrodynamic runs included metrics such as mass flow rate and transient switching On/Off response to gauge relative performance. Due to the large number of particles considered, the overall problem size was very large. At 1 kHz gating frequency, the time constant is only 1 ms. Therefore, most runs were for durations of 5 ms to reach somewhat steady-state conditions.

Figure 16:
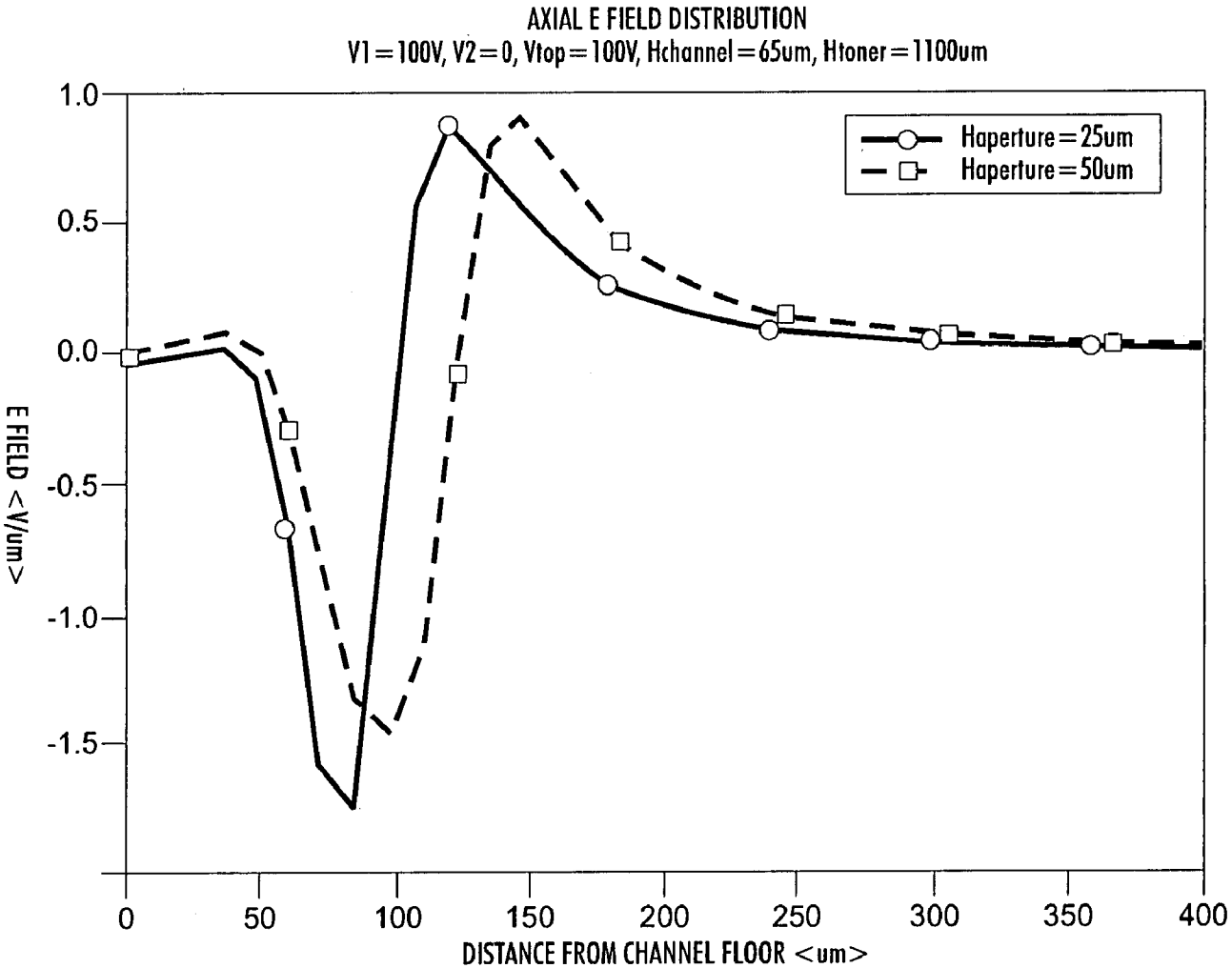
FIG. 16 is a graph of E field as a function of distance from a toner inlet.
Figure 17:
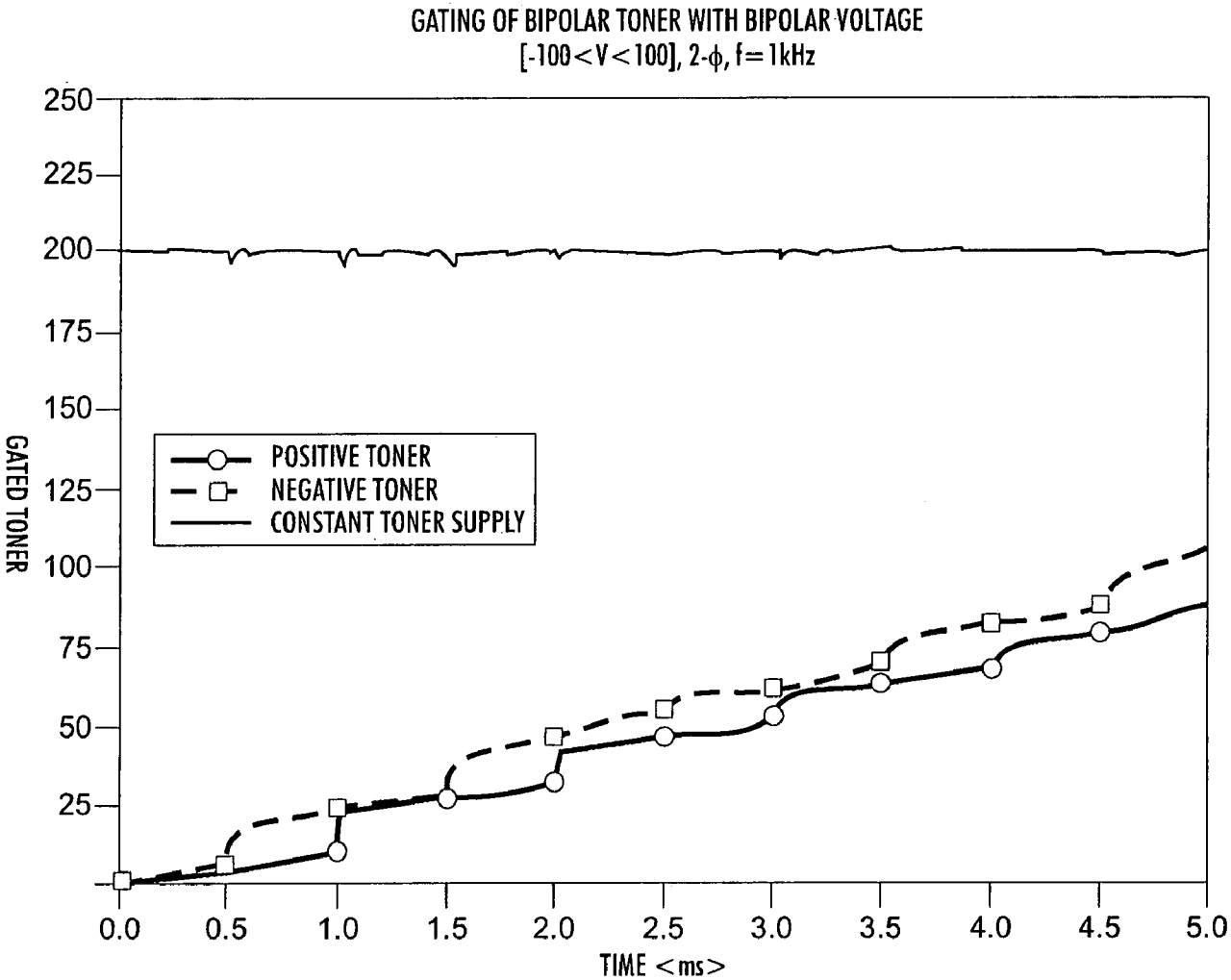
FIG. 17 is a graph of gated toner as a function of time.
Figure 18:
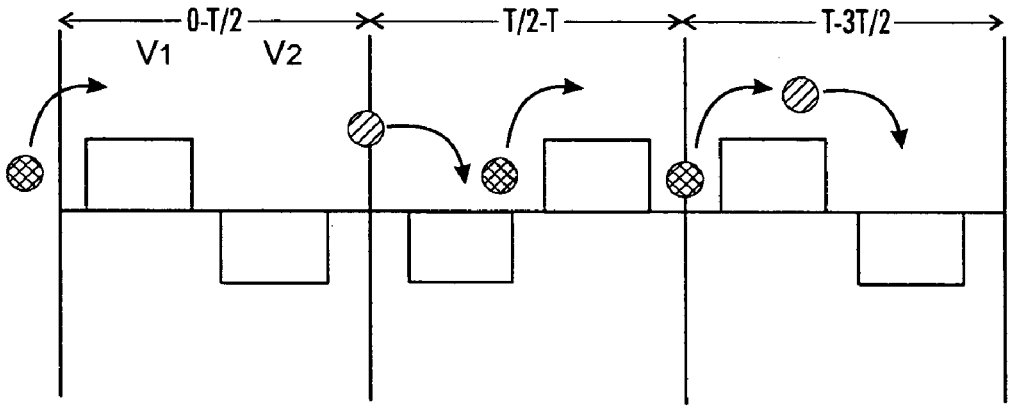
FIG. 18 is a schematic illustration of an exemplary embodiment technique of gating bipolar toner with bipolar voltage.
Figure 19:
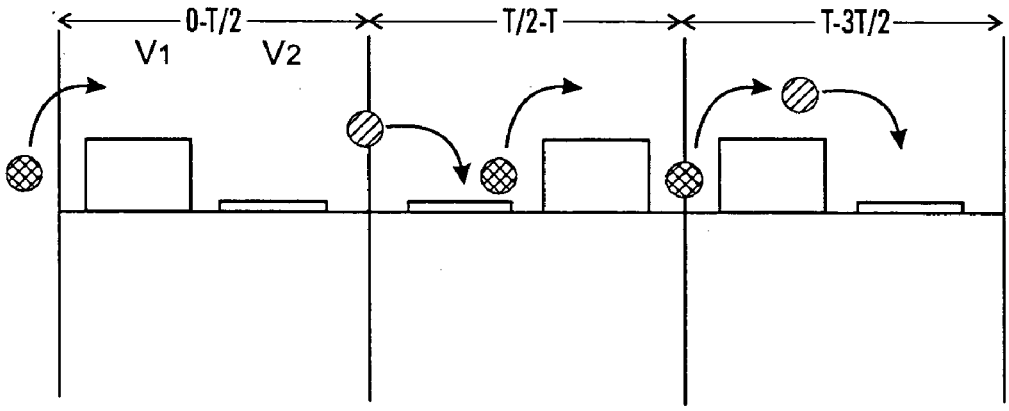
FIG. 19 is a schematic illustration of an exemplary embodiment technique of gating bipolar toner with unipolar voltage.

The electrostatic fields in the vicinity of the aperture were modeled to quantify the "reach" of the fringe fields. Gating rate and response time are dependent on both the magnitude of the gating voltage and proximity of the toner to the inlet. At electrode voltages of 100 V, the axial E field dies off within 200 μm as shown in FIG. 16. The transient response of bipolar toner to 2 phase bipolar gating voltages is shown in FIG. 17. Positive and negative toner curves show "stair case" profiles. The gating mechanism of the 2 phase configuration is a "pull-push" effort much like a two-stroke engine. Each of the two electrodes alternately pulls the opposite sign toner to load the aperture and pushes on it in the second half-cycle to clear the aperture. The respective actions are coordinated exactly 180 degrees, or nearly so, out of phase. Animations of particle dynamics show this distinct jerky behavior. To illustrate, consider gating bipolar toner with bipolar voltage as shown in FIG. 18. On the first half-cycle, the entrance electrode $V_1$ goes positive and the exit electrode $V_2$ goes negative. The entrance electrode acts to "pull" negative toner into the aperture and at the same time "push" out positive toner already in the aperture by displacement. The exit electrode also exerts a pull on the positive toner. On the next half-cycle, the opposite happens. The entrance electrode $V_1$ goes negative and the exit electrode $V_2$ goes positive. Positive toner is now pulled into the aperture and at the same time, negative toner is drawn out of the exit by the combined push from the entrance electrode and pull from the exit electrode. This cycle repeats resulting in a two-stroke pumping action that funnels toner from the supply side to the exit side. Although this mechanism appears jerky at low frequencies, it smoothes out rapidly at the more optimal higher operating frequencies. Gating bipolar toner with unipolar voltage is shown in FIG. 19 and is a subset of the bipolar voltage version, and will be understood from the preceding description.

Figure 20:
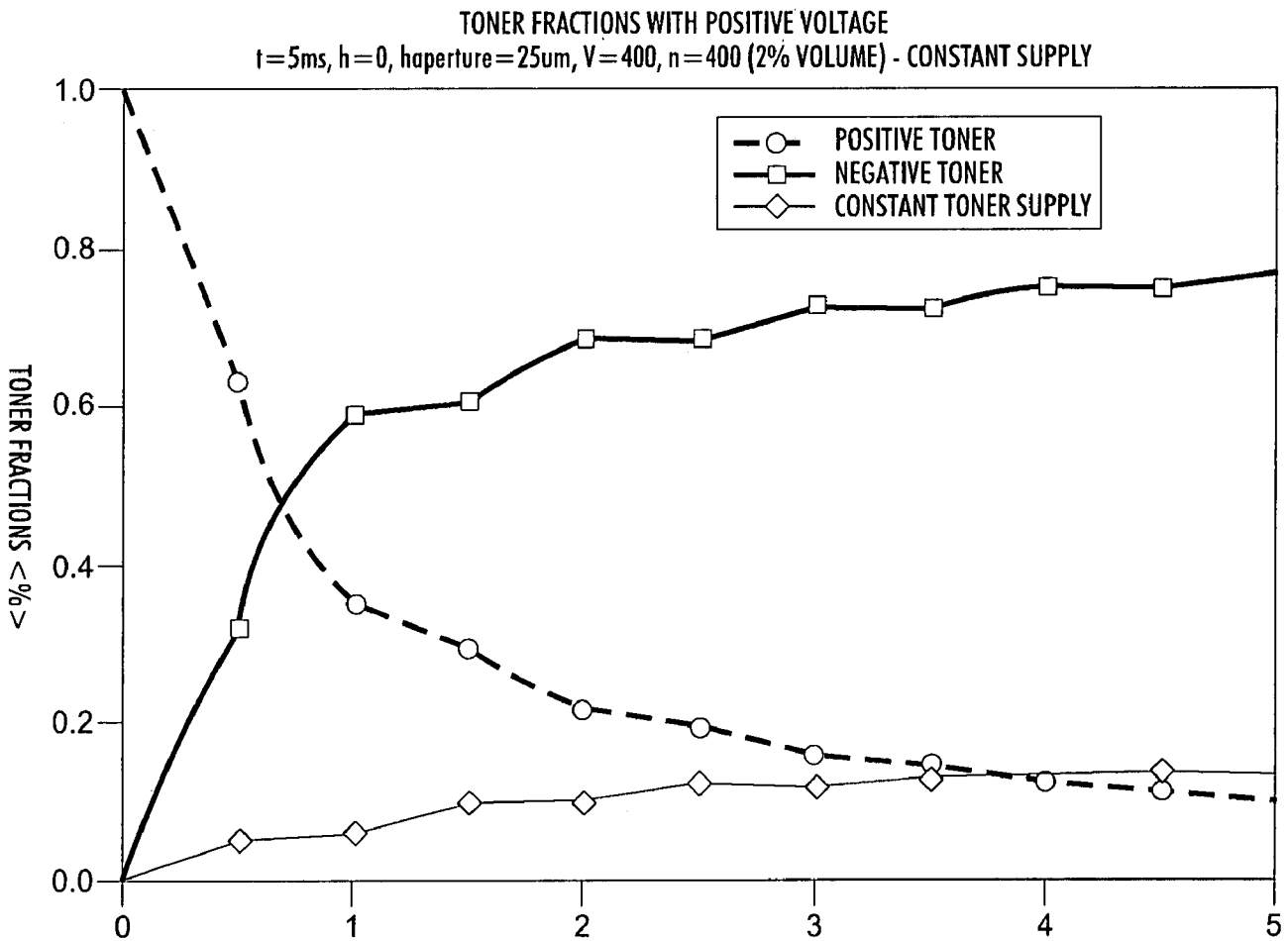
FIG. 20 is a graph of negative toner fraction gated with positive voltage as a function of time.
Figure 21:
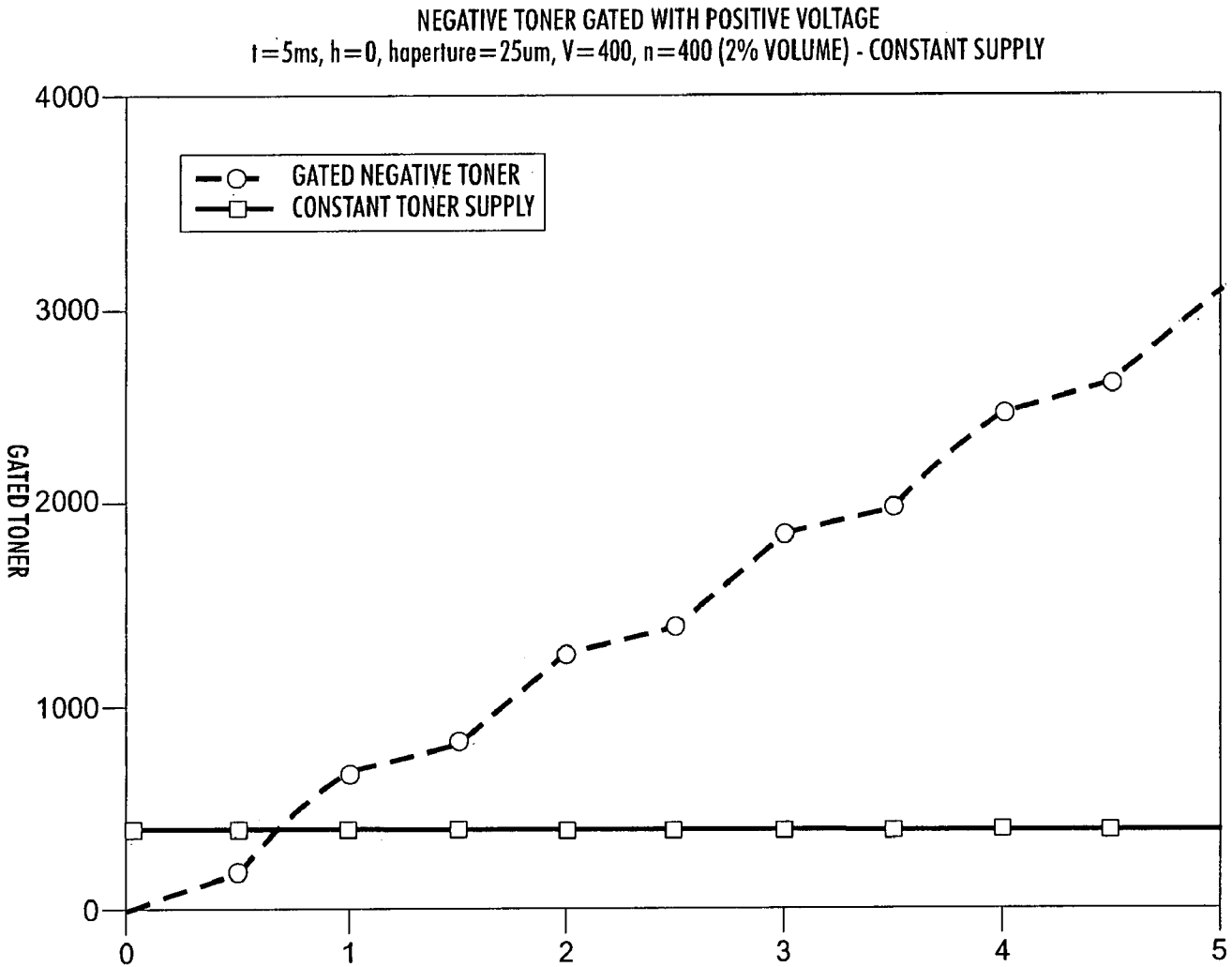
FIG. 21 is a graph of negative toner fraction gated with positive voltage as a function of time.

FIG. 20 shows the gating response curves for negative toner fractions using positive voltages. The time constant is seen to be less than 1 ms. At 5 ms, the gating efficiency approaches 80% for 2% volume toner density. In FIG. 21, the characteristic two-stroke action previously described is illustrated. The second half-cycle has a steeper slope because of the combined push from the entrance electrode and pull from the exit electrode. The gating rate obtained from the slope of the graph in FIG. 21 is $6\times10^5$/s. The incremental toner gated is also expressible as 1500/V.s. The computed thickness of 28.56 μm represents more than 4 layers of 5.8 μm toner at 1 ips. For a monolayer, the medium speed may be increased to 5 ips (or 30 ppm). At 4% toner density, the print speed may be inferred to be 60 ppm. The flow rate per 50 μm aperture is 50 μg/s. Therefore, a 10×10 array of these apertures spaced 4 mils on centers would be about 1 $mm^2$, and could deliver 5 mg/s of toner. The printed mass per unit area (pma) for gated toner may be estimated from the following considerations. The model is used to compute a gating rate for toner per aperture. Assuming that this toner is printed on a moving medium without any scatter, i.e. all toner is deposited, the gated mass per unit time is $n_g m$, where $n_g$ is the gating rate and m is the toner mass. With $v_{media}$ as medium velocity, w as printed line width, and r as toner mass density, pma is given by:

$$pma=n_g m/v_{media} w$$

and the thickness of the printed layer is given by:

$$t=pma/p$$

A typical calculation follows for a medium velocity of 1 ips. The gating rate is obtained from the slope of the gating graph in FIG. 21. The computed thickness of 28.56 μm represents more than 4 layers of 5.8 um toner. For a monolayer, the medium speed may be increased to 5 ips. Other relevant information are contained in Table 1.

Figure 22:
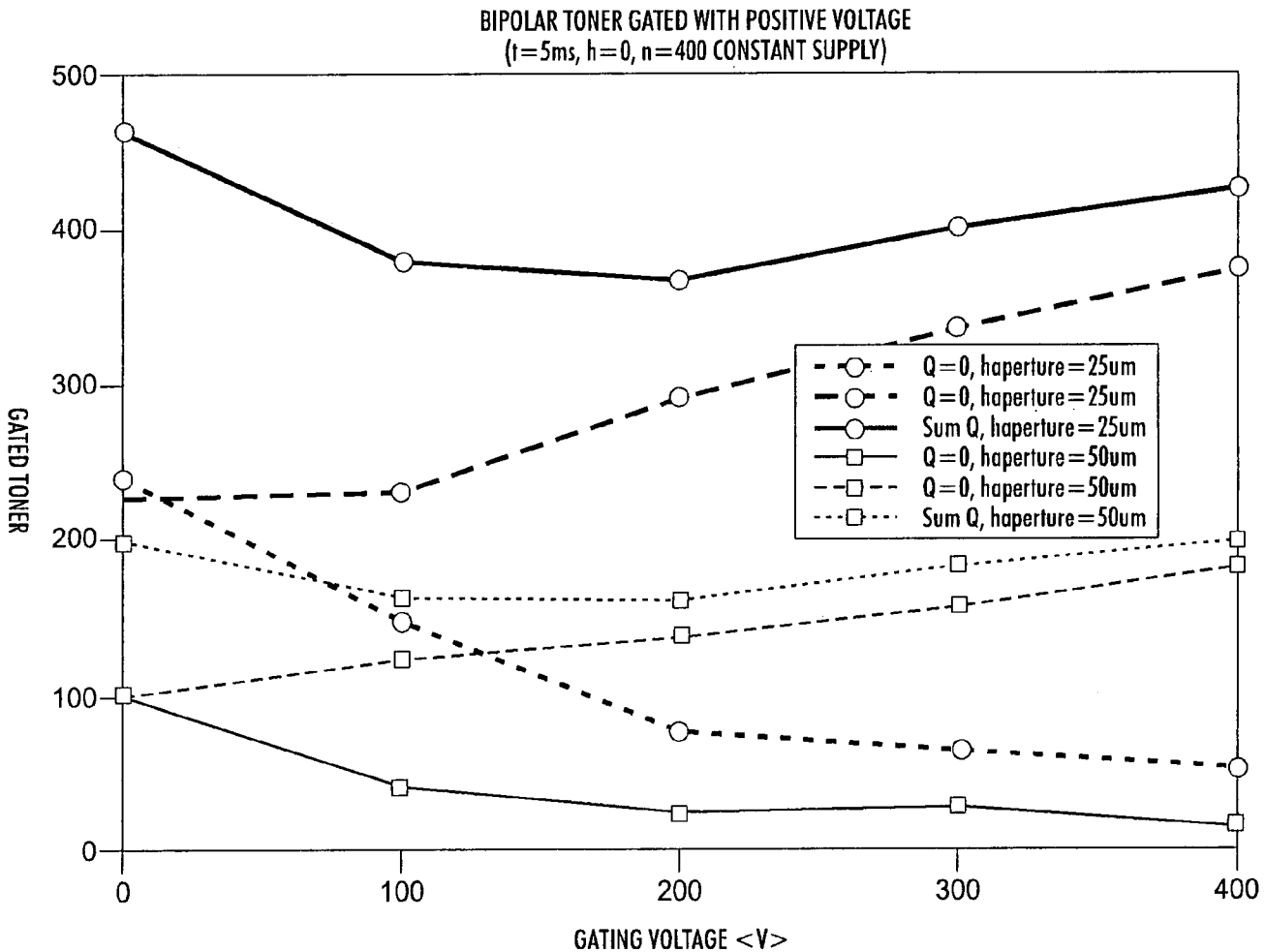
FIG. 22 is a graph of bipolar toner gated with positive voltage.
Figure 23:
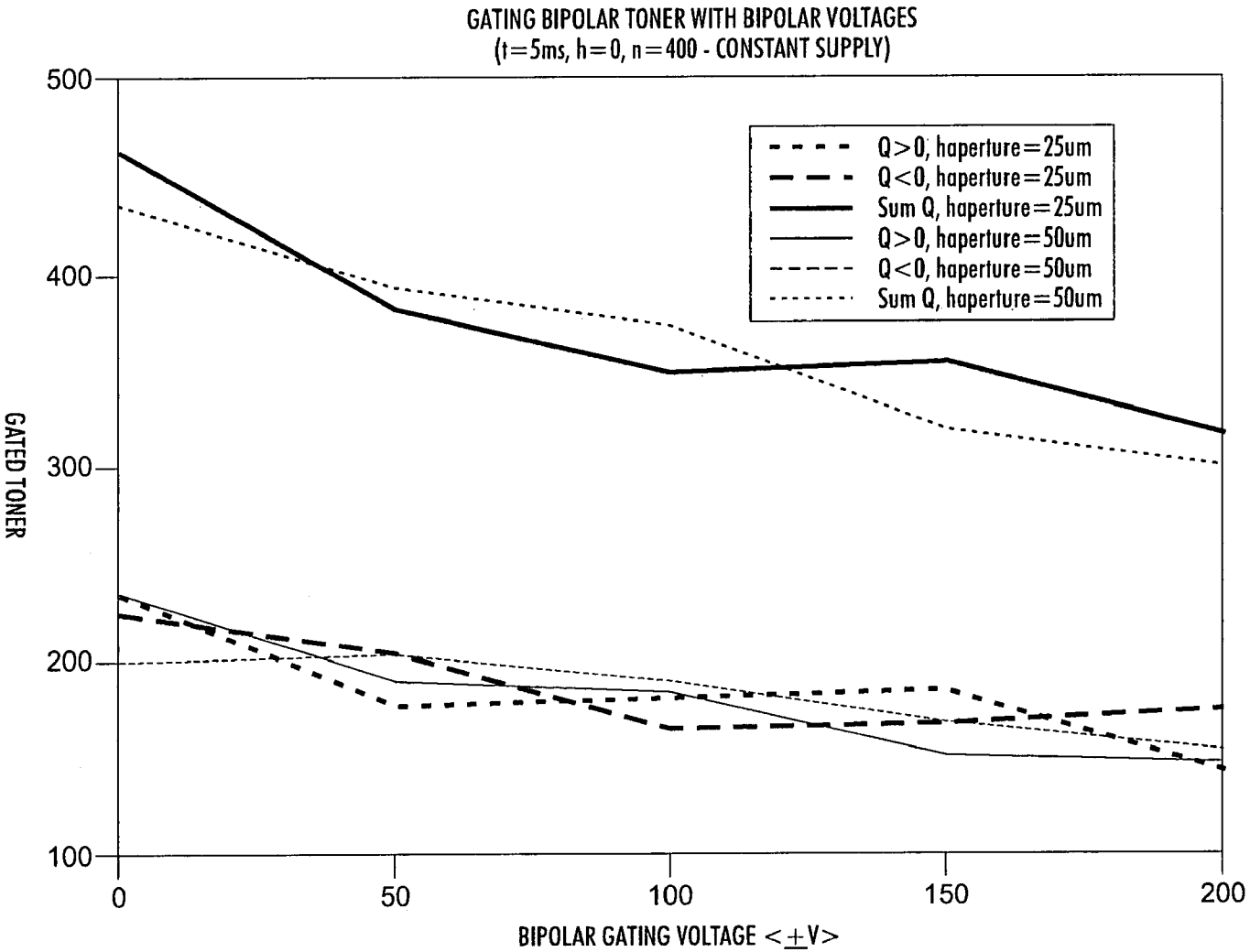
FIG. 23 is a graph of bipolar toner gated with bipolar voltages.
Figure 24:
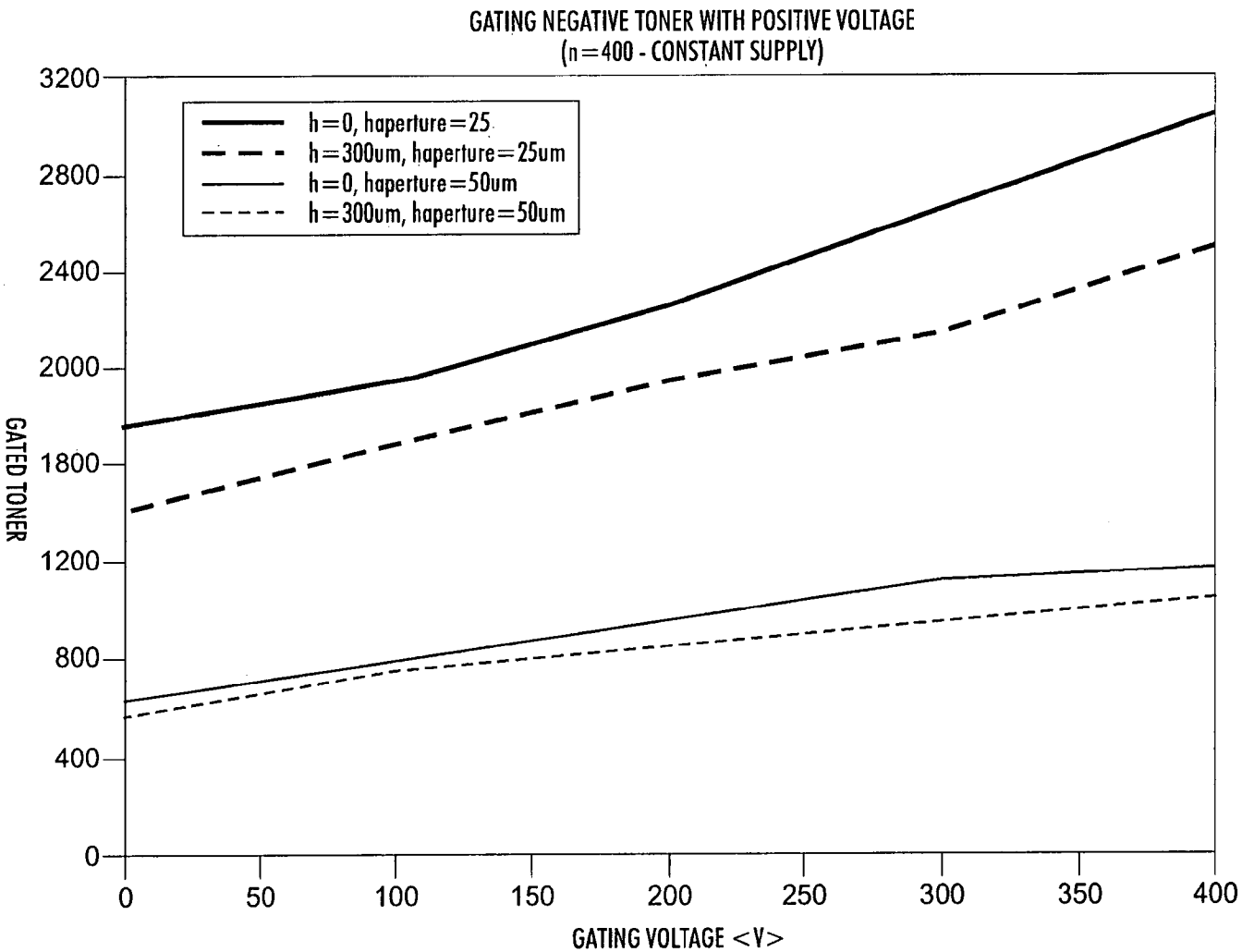
FIG. 24 is a graph of negative toner gated with positive voltage.

The relative performance of 2 phase, 2 phase plus D.C., and 3 phase gating configurations may be appreciated by comparing their throughput curves for the first 5 ms. FIG. 22 shows bipolar toner gated with positive voltage. Polarity selectivity is evident as more negative toner and less positive toner are gated with increasing voltage magnitude. The sum of all gated toner appears to be insensitive to voltage increase except for a slight dip between 100 V to 200 V. The shorter aperture results in increased gated toner primarily due to the 2× axial field. FIG. 23 shows bipolar toner gated with bipolar voltages. The positive, negative and overall sum of all gated toner appears to decrease with increasing voltage due to depletion of the toner supply at the inlet from repulsion of same sign toner for each half-cycle. Similar gating levels for both aperture heights indicate that the "pull" half-cycle determines mass flow rate. Approximately equal amounts of positive and negative toner are gated. Finally, FIG. 24 shows results for negative toner gated with positive voltage. Gating continues even when the electrodes are grounded due to the self-field of both toner species. Unipolar toner appears to be gated efficiently by electrode voltages of the opposite polarity. The volume of gated toner increases with increasing voltage. The shorter aperture height has higher efficiency due to the 2× field. Also, the gating efficiency and rate are lower when the toner layer is further away from the aperture.

Figure 25:
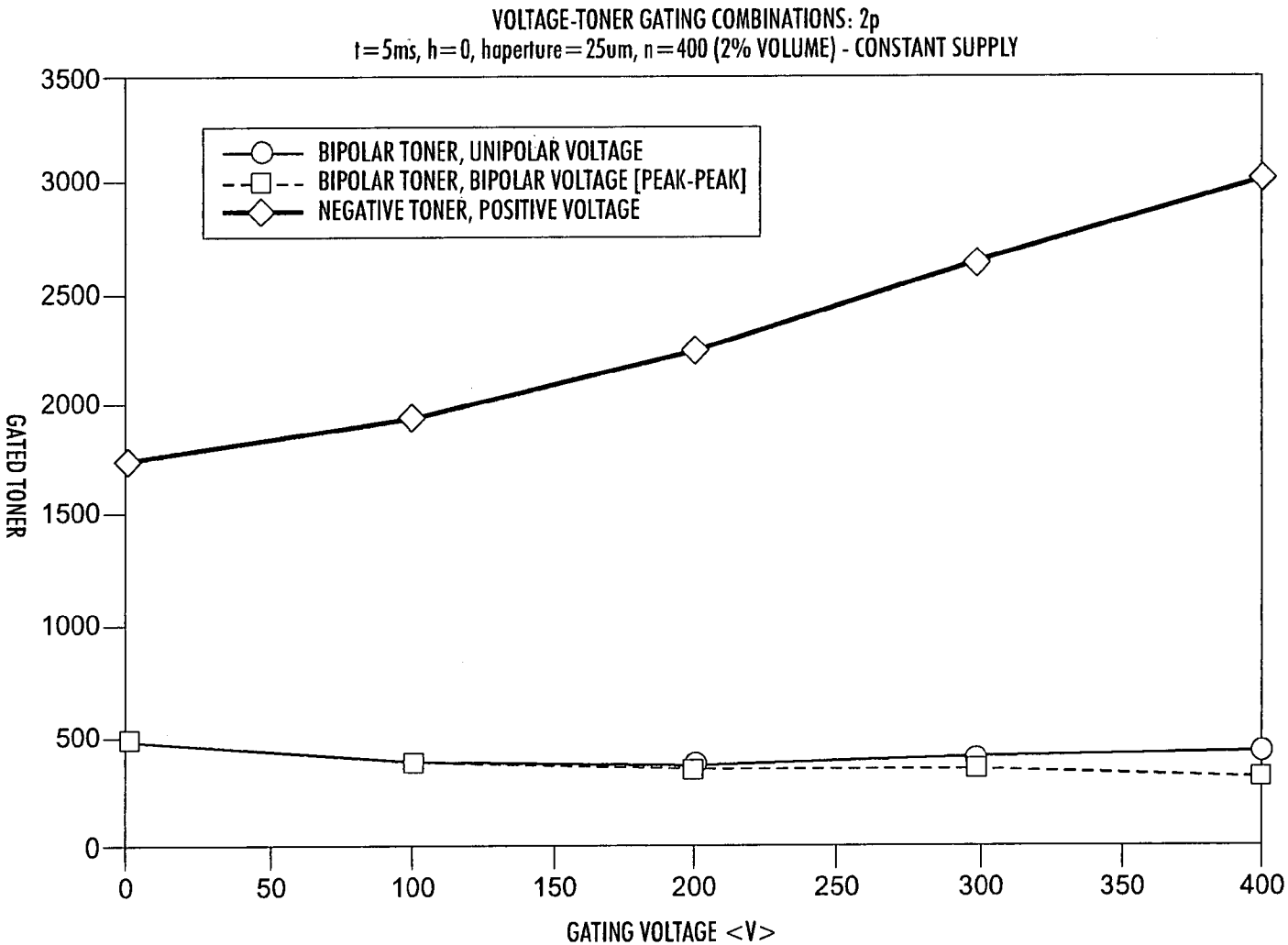
FIG. 25 is a graph of various voltage-toner gating combinations.

Several conditions have been identified for optimal toner gating. These are as follows. The gating efficiency of bipolar toner is between 40% and 50% compared to 80% to 90% for unipolar toner. Bipolar toner does not gate well with bipolar voltage. Bipolar toner gating is also insensitive to the range of unipolar voltages. The best combination is unipolar voltage of opposite polarity to the charge on the toner, i.e. $V>0$ for $Q<0$ and vice versa. FIG. 25 shows a comparison of gating curves as functions of gating voltages. The latter combination results in an approximately linear relationship, which can be exploited for gray level control.

Figure 26:
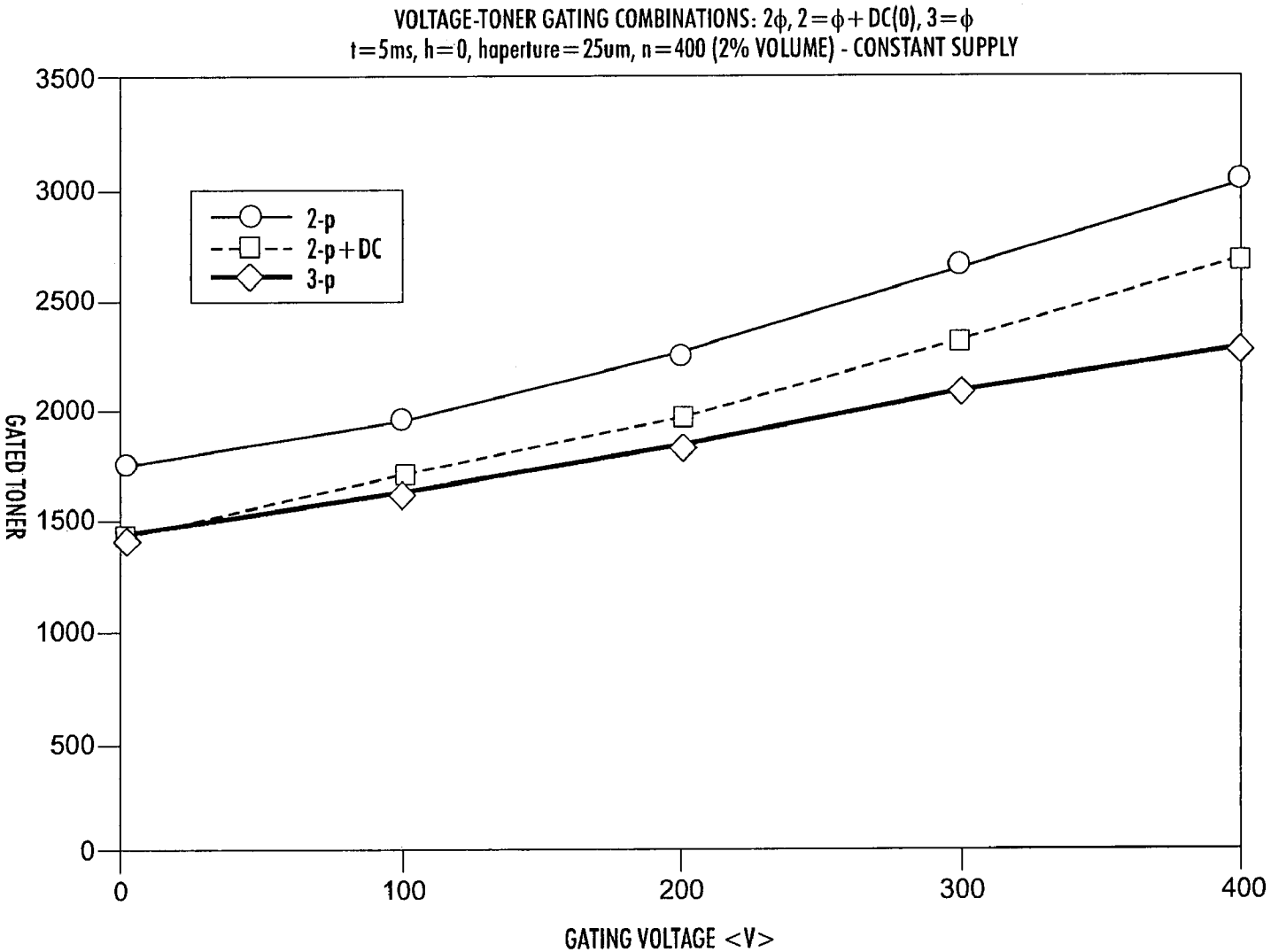
FIG. 26 is another graph of various voltage-toner gating combinations.

The best gating configuration appears to be 2 phase as shown in FIG. 26. Remarkably, this is the simplest configuration of the three to implement.

For optimal 2 phase gating, low agglomeration fluidized toner is needed to feed the aperture using a low agitation method; thus excluding piezo and acoustic mechanisms.

For optimal 2 phase gating, high toner density is needed in the vicinity of the aperture entrance. The E field also needs to be maximized to "pull" toner into the aperture (optimize V and aperture height). Similarly, the E field also needs to be maximized to "push" toner through the aperture.

For optimal 2 phase gating, an increase in constant toner supply increases gating efficiency. Increase in the constant supply rate increases the slope or rate of the gating curve.

For optimal 2 phase gating, for small apertures, the entrance electrode may actually shield the effect of the exit or third electrode.

For optimal 2 phase gating, the combination of "pull-push" 2-stroke pumping action should be optimized. The maximum flow rate depends on aperture volume, packing fraction of toner, and gating frequency.

Sufficiently high gating frequency (1 kHz to 20 kHz or higher) is needed to minimize latency or toner hopping time on electrodes while waiting for the next "voltage wave" to move it. There is also the need to minimize toner transit time in the aperture, effectively reducing flow resistance and preventing aperture clogging.

For optimal 2 phase gating, the hydrodynamic balance between "bleed flow" from gas channel and drift-diffusion Coulomb forces of toner self-field should be optimized.

Although the exemplary embodiment has been described with reference to controlling the flow rate or stopping the flow of particles in a gas stream or to a gas stream, it will be appreciated that the exemplary embodiment includes applications in which the flows involve liquid flows or a combination of gas and liquid flow. Moreover, the flow of particles in a vacuum or near-vacuum are also encompassed by the exemplary embodiment.

A wide array of particles may be transported or otherwise selectively administered using the exemplary embodiment systems. When transporting through air, particles can be as large as up to about 40 μm depending upon the voltage, physical configuration of the electrodes, and the electrode duty cycle employed. It is contemplated that the exemplary embodiment systems can be used in conjunction with larger particle sizes. The physical configuration of the electrodes and their aperture size is primarily dependent upon the size of the particles to be gated. As described herein, 50 μm apertures have been used to gate particles having sizes up to about 10 μm. Smaller apertures are contemplated. Aperture diameter is a factor in the gating of particles.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A system for selectively controlling particle flow, the system comprising:

a passage adapted for housing the flow of a gas therethrough, the passage defining an inlet and an outlet;

a particle container;

a branch conduit providing communication between the passage and the particle container, the branch conduit providing communication with the passage at a location between the inlet and the outlet;

a gating assembly defining an aperture and disposed in the branch conduit, the gating assembly including a first electrode and a second electrode adapted to emit electric fields proximate to a particle flow traveling through the aperture, wherein the aperture has an opening span of from about 25 μm to about 75 μm.

2. A method for stopping particle flow from a particle source to a flowing medium in a system comprising (i) a passage adapted for housing a flowing medium, (ii) a particle source, and (iii) a conduit providing communication between the passage and the particle source, wherein as a result of the flowing medium in the passage, particles from the particle source are drawn toward the flowing medium, the method comprising:

directing a minor flow from the flowing medium into the conduit' to provide a counter flow to offset the flow of particles from the particle source to the flowing medium otherwise occurring.

3. The method of claim 2 wherein the step of directing a minor flow from the flowing medium is achieved by providing an outlet in the conduit to thereby provide a flow path of the minor flow from the passage, into the conduit, and out of the conduit.

4. The method of claim 2 wherein the step of directing a minor flow from the flowing medium is achieved by providing a flow orifice in the conduit through which either the minor flow passes or particles from the particle source pass when drawn to the flowing medium, wherein the flow orifice defines an aperture.

5. A method for stopping particle flow from a particle source to a flowing medium in a system comprising (i) a passage adapted for housing a flowing medium, (ii) a particle source, and (iii) a conduit providing communication between the passage and the particle source, wherein as a result of the flowing medium in the passage, particles from the particle source are drawn toward the flowing medium, the method comprising:

providing an electrode assembly in the conduit such that particles flowing from the particle source to the passage, flow past and in close proximity to the electrode assembly; and applying a 2 phase voltage waveform to the electrode assembly to selectively stop particle flow from the particle source to the passage.

6. The method of claim 5 wherein the electrode assembly comprises at least a first annular entrance electrode and a second annular exit electrode spaced from the first electrode, each of the electrodes defining an aperture through which particles in the system can pass.

7. The method of claim 6 wherein the step of applying the voltage waveform to the electrode assembly is performed by (i) applying a voltage to the exit electrode that is opposite to the charge of particles and (ii) grounding the entrance electrode.

8. The method of claim 6 wherein the step of applying the voltage waveform to the electrode assembly is performed by applying a voltage to both the exit electrode and the entrance electrode that is opposite to the charge of particles.

9. A method for selectively controlling particle flow from a particle source to a flowing medium in a system comprising (i) a passage adapted for housing a flowing medium, (ii) a particle source, (iii) a conduit providing communication between the passage and the particle source, and (iv) an electrode assembly disposed in the conduit, the assembly including an entrance electrode and an exit electrode, the method comprising:

applying a variable voltage to the exit electrode whereby the particle flow from the particle source to the flowing medium is controlled by varying the voltage applied to the exit electrode.

10. The method of claim 9 wherein at least a majority of the particles in the system are unipolar.

* * * * *